US009444194B2

(12) United States Patent
Tanaka et al.

(10) Patent No.: US 9,444,194 B2
(45) Date of Patent: Sep. 13, 2016

(54) CONNECTOR WITH SHEET

(71) Applicant: Molex, LLC, Lisle, IL (US)

(72) Inventors: Mikiji Tanaka, Fujisawa (JP); Hideki Hozono, Yamato (JP); Mari Niita, Yamato (JP); Shigeyuki Hoshikawa, Yokohama (JP); Kazumi Yamamoto, Yamato (JP)

(73) Assignees: MOLEX, LLC, Lisle, IL (US); TODA KOGYO CORP., Otake (JP)

( * ) Notice: Subject to any disclaimer, the term of this patent is extended or adjusted under 35 U.S.C. 154(b) by 0 days.

(21) Appl. No.: 14/378,777

(22) PCT Filed: Mar. 28, 2013

(86) PCT No.: PCT/US2013/034249

§ 371 (c)(1),
(2) Date: Aug. 14, 2014

(87) PCT Pub. No.: WO2013/148936

PCT Pub. Date: Oct. 3, 2013

(65) Prior Publication Data

US 2016/0087379 A1 Mar. 24, 2016

(30) Foreign Application Priority Data

Mar. 30, 2012 (JP) ..... 2012-080221
Dec. 17, 2012 (JP) ..... 2012-274181
Dec. 19, 2012 (JP) ..... 2012-277341

(51) Int. Cl.
*H01R 13/648* (2006.01)
*H01R 13/6599* (2011.01)
*H01R 12/79* (2011.01)

(52) U.S. Cl.
CPC ..... *H01R 13/6599* (2013.01); *H01R 12/79* (2013.01)

(58) Field of Classification Search
CPC ..... H01R 13/65802; H01R 13/658; H01R 13/506; H01R 23/6873; H01R 23/7073
USPC ..... 439/607.01–607.4
See application file for complete search history.

(56) References Cited

U.S. PATENT DOCUMENTS 2,405,987 A * 8/1946 Arnold ..... H05K 9/0001 174/159
4,878,858 A 11/1989 Dechelette
(Continued)

FOREIGN PATENT DOCUMENTS

JP 02-265183 A 10/1990
JP 06-084680 U 12/1994
(Continued)

OTHER PUBLICATIONS

International Search Report for PCT/US2013/034249.

*Primary Examiner* — Abdullah Riyami
*Assistant Examiner* — Vladimir Imas
(74) *Attorney, Agent, or Firm* — James A. O'Malley; Stephen L. Sheldon

(57) ABSTRACT

A connector with a sheet has a housing mated with another connector, a terminal secured to the housing and contacting another terminal on the other connector, and a sheet affixed to the housing. The sheet has a laminate structure which includes a soft magnetic layer having real parts of complex relative permeability at 100 MHz of from 20 to 45, and a conductive/dielectric layer having an electrical resistance of from 0.5 to 20 Ω·cm.

7 Claims, 16 Drawing Sheets

(56) References Cited

U.S. PATENT DOCUMENTS

| | | | | |
|---|---|---|---|---|
| 4,889,503 | A * | 12/1989 | Philippson | H01R 13/65802 439/607.45 |
| 5,326,281 | A * | 7/1994 | Yin | H01R 13/6581 439/607.01 |
| 5,581,065 | A * | 12/1996 | Nishikawa | G06K 19/072 235/487 |
| 5,596,170 | A * | 1/1997 | Barina | H01R 13/2407 174/366 |
| 6,276,966 | B1 | 8/2001 | Yamoto et al. | |
| 6,416,830 | B2 | 7/2002 | Yoshida et al. | |
| 7,273,396 | B2 | 9/2007 | Itano et al. | |
| 7,625,640 | B2 * | 12/2009 | Kawaguchi | H01F 1/00 428/692.1 |
| 7,667,655 | B2 * | 2/2010 | Inoue | H01F 10/131 343/702 |
| 7,799,147 | B2 * | 9/2010 | Matsukawa | H01F 1/14766 148/306 |
| 7,824,219 | B2 * | 11/2010 | Wang | H01R 13/65802 439/607.27 |
| 9,231,356 | B1 * | 1/2016 | Ju | H01R 24/78 |
| 2004/0219328 | A1 | 11/2004 | Tasaki et al. | |

FOREIGN PATENT DOCUMENTS

| | | | |
|---|---|---|---|
| JP | 10-12315 | A | 1/1998 |
| JP | 11-176521 | A | 7/1999 |
| JP | 11-233200 | A | 8/1999 |
| JP | 11-245783 | A | 9/1999 |
| JP | 2001-006823 | A | 1/2001 |
| JP | 2007-035308 | A | 2/2007 |
| JP | 2008-186997 | A | 8/2008 |
| KR | 2010-0011673 | A | 2/2010 |
| KR | 10-1019963 | B1 | 3/2011 |

* cited by examiner

| (a) | | Conductive Dielectric Layer | | Magnetic Layer | | Electric Field Strength Near Housing and S11 | | | | | | | |
|---|---|---|---|---|---|---|---|---|---|---|---|---|---|
| | | Electrical Resistance | Thick-ness | Permeability | Thick-ness | 100 | | 500 | | 1000 | | 3000 | |
| | | Ωcm | μm | μ(100MHz) | μm | Electric field Strength (dB) | S11 (dB) | Electric field Strength (dB) | S11 (dB) | Electric field Strength (dB) | S11 (dB) | Electric field Strength (dB) | S11 (dB) |
| Example | 1 | 14 | 20 | 25 | 80 | -2.2 | -17.7 | -0.6 | -13.1 | 0.0 | -15.8 | -0.8 | -21.1 |
| | 2 | 5 | 20 | 30 | 80 | -1.0 | -13.9 | -0.6 | -11.2 | -0.1 | -15.1 | -1.8 | -18.4 |
| | 3 | 10 | 20 | 40 | 80 | -2.6 | -18.7 | -1.0 | -14.3 | 0.0 | -16.1 | -0.7 | -22.1 |
| | 4 | 2 | 20 | 40 | 80 | -0.1 | -15.1 | -1.2 | -12.8 | -2.7 | -16.5 | -2.5 | -20.2 |
| | 5 | 0.5 | 20 | 40 | 80 | -1.2 | -12.0 | -2.5 | -10.4 | -3.9 | -14.0 | -4.0 | -19.3 |
| Comparative Example | 1 | 0.02 | 10 | - | | -2.3 | -8.7 | -18.0 | -2.1 | -24.3 | -1.6 | -20.6 | -3.2 |
| | 2 | 0.02 | 10 | - | | -14.4 | -10.2 | -28.0 | -2.7 | -29.7 | -10.5 | -20.6 | -18.5 |
| | 3 | 0.3 | 30 | - | | -1.0 | -9.3 | -10.5 | -5.3 | -13.1 | -10.5 | -11.8 | -13.1 |
| | 4 | 0.5 | 20 | - | | -3.2 | -9.2 | -2.6 | -7.9 | -4.5 | -8.9 | -4.6 | -9.2 |
| | 5 | - | - | 50 | 100 | 0.6 | -19.3 | -1.2 | -12.7 | -4.2 | -17.1 | -4.4 | -13.1 |

FIG. 6A

| (b) | | Conductive Dielectric Layer | | Magnetic Layer | | Electric Field Strength Near Housing and S11 | | | | | | | |
|---|---|---|---|---|---|---|---|---|---|---|---|---|---|
| | | Electrical Resistance | Thick-ness | Permeability | Thick-ness | 100 | | 500 | | 1000 | | 3000 | |
| | | Ωcm | μm | μ(100MHz) | μm | Magnetic field Strength (dB) | S11 (dB) | Magnetic field Strength (dB) | S11 (dB) | Magnetic field Strength (dB) | S11 (dB) | Magnetic field Strength (dB) | S11 (dB) |
| Example | 1 | 14 | 20 | 25 | 80 | 0.0 | -17.7 | -0.7 | -13.1 | -2.1 | -15.8 | -2.0 | -21.1 |
| | 2 | 5 | 20 | 30 | 80 | -0.2 | -13.9 | -1.8 | -11.2 | -3.0 | -15.1 | -3.0 | -18.4 |
| | 3 | 10 | 20 | 40 | 80 | 0.0 | -18.7 | -0.6 | -14.3 | -2.0 | -16.1 | -2.0 | -22.1 |
| | 4 | 2 | 20 | 40 | 80 | -3.1 | -15.1 | -0.8 | -12.8 | 0.0 | -16.5 | -1.4 | -20.2 |
| | 5 | 0.5 | 20 | 40 | 80 | -3.0 | -12 | -1.4 | -10.4 | -1.0 | -14.0 | -3.0 | -19.3 |
| Comparative Example | 1 | 0.02 | 10 | - | | -0.4 | -8.7 | -7.6 | -2.1 | -14.4 | -1.6 | -21.0 | -3.2 |
| | 2 | 0.02 | 10 | - | | -1.1 | -10.2 | -13.8 | -2.7 | -12.9 | -10.5 | -21.7 | -18.5 |
| | 3 | 0.3 | 30 | - | | 0.8 | -9.3 | 1.5 | -5.3 | -0.8 | -10.5 | -10.6 | -13.1 |
| | 4 | 0.5 | 20 | - | - | -0.3 | -9.2 | -0.3 | -7.9 | 0.0 | -8.9 | -0.2 | -9.2 |
| | 5 | - | - | 50 | 100 | -6.0 | -19.3 | -1.6 | -12.7 | 1.2 | -17.1 | -1.7 | -13.1 |

FIG. 6B

CONNECTOR WITH SHEET

RELATED APPLICATIONS

The application claims priority to Japanese Patent Application No. 2012-080221, filed Mar. 30, 2012; to Japanese Patent Application No. 2012-274181 filed Dec. 17, 2012 and to Japanese Patent Application No. 2012-277341, filed Dec. 19, 2012, all of which are incorporated herein by reference in their entirety.

FIELD OF THE INVENTION

The present invention is related to a connector, more specifically to a connector designed to reduce electromagnetic interference with a sheet.

DESCRIPTION OF RELATED ART

The use of a sheet with a connector to suppress the adverse effects of noise on signals received via terminals (see, for example, Laid-Open Patent Publication No. 11-245783). FIG. 14 shows a side view of a prior art connector with a laminate structure.

In this drawing, 811 is the housing of the connector with a laminate structure which is mounted on a circuit board 891. This housing 811 has a cylindrical sleeve 814, and a rectangular main portion 815 connected to the rear end of the sleeve 814. Although not shown in the drawing, an insertion opening is also formed for the insertion of another connector, which extends from the sleeve 814 to the main portion 815. A plurality of terminals 861 is disposed in the sleeve 814 and the main portion 815. The tail portion 862 of each terminal 861 is inserted into a through-hole 892 formed in the circuit board 891 and passes through the circuit board 891.

The circuit board 891 is disposed inside the case of an electronic device which is not shown in the drawing. Here, 895 is the metal chassis of the electronic device. The front face and the left and right side faces of the housing 811 are covered with a shield panel 871. Here, 816 is a locking groove formed in a side surface of the housing 811. A locking claw not shown in the drawing on the shield panel 871 is locked in this groove to secure the shield panel 871 to the housing 811. The shield panel 871 has a contact piece 873 extending downward and a pressure applying piece 872 extending forward. The contact piece 873 is inserted and connected to the ground pattern in a through-hole 892, and passes through the circuit board 891. The pressure applying piece 872 makes contact with the metal chassis 895.

A shield absorbing elastic panel 875 is disposed to cover the bottom face of the housing 811. The shield absorbing elastic panel 875 is a rectangular laminate made of alternating rubber shielding layers and electromagnetic wave absorbing layers consisting of a weakly magnetic powder with a strong magnetic flux density dispersed in rubber. The contact piece 873 is inserted into a through-hole formed in the shield absorbing elastic panel 875 and passes through the shield absorbing elastic panel 875. The shield panel 871 covers the left and right side faces of the housing 811 to prevent noise, and the shield absorbing elastic panel 875 on the bottom face of the housing 811 helps block high-frequency noise.

However, in the depicted connector the shield panel 871 and the shield absorbing elastic panel 875 need to be mounted in order to cover the housing 811. This makes the structure of the shield panel 871 and the shield absorbing elastic panel 875 more complicated. Also, because the shield panel 871 and the shield absorbing elastic panel 875 have to be connected to and grounded by the ground pattern of the circuit board 891 and the metal chassis 895 of the electronic device, the structure of the shield panel 871 and the shield absorbing elastic panel 875 is more complicated. When the connector is used to connect a high-frequency signal circuit, signal integrity can be adversely affected because a wide-area shield panel 871 surrounds the terminals 861 of the high-frequency signal path, and the waveform of the high-frequency signals can be distorted. Thus, certain individuals would appreciate further improvements in a connector.

BRIEF SUMMARY

In an embodiment, a connector is disclosed with a sheet having a housing configured to mated with another connector, a terminal secured to the housing and configured to contact another terminal on the other connector, and a sheet affixed to the housing. The sheet can be a suppressive sheet having a laminate structure with a magnetic layer and a dielectric layer. In an embodiment the sheet is affixed to the outer face of the housing so as to cover the portion directly above the location where the terminal mates with a mating terminal. In an embodiment the sheet is affixed to an outer face of the housing, and this outer face is not a mating face or a mounting face. The housing is made of a dielectric material, and a dielectric constant of the dielectric layer is greater than a dielectric constant of the housing. The base material of the magnetic layer and the dielectric layer can be a thermosetting resin. The sheet can be configured so the dielectric layer is adjacent to the housing, and the magnetic layer is adjacent to the dielectric layer. The magnetic layer can be formed with a soft magnetic powder and the dielectric layer can include a conductive filler. If desired, the soft magnetic powder used in the soft magnetic layer can be a flaky soft magnetic metal powder and the conductive filler used in the conductive/dielectric layer can be conductive carbon fibers.

BRIEF DESCRIPTION OF THE DRAWINGS

The present invention is illustrated by way of example and not limited in the accompanying figures in which like reference numerals indicate similar elements and in which:

FIG. 6A is a table showing the measured values for electric field strength.

FIG. 6B is a table showing the measured values for magnetic field strength

DETAILED DESCRIPTION

Figure 1:
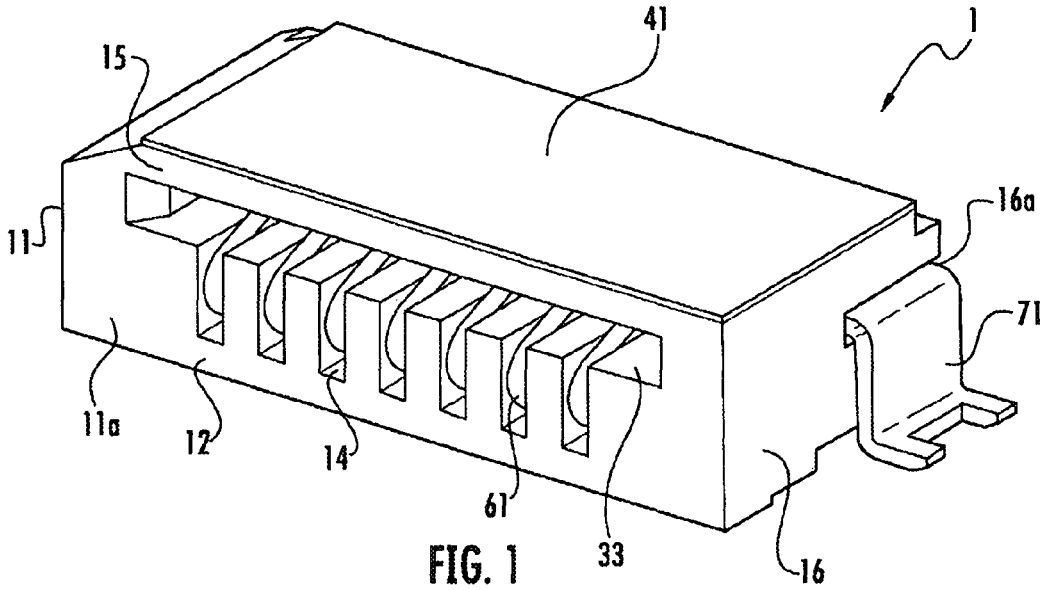
FIG. 1 shows a perspective view of an embodiment of a connector with a sheet.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity. In addition, expressions indicating direction; such as up, down, left, right, front and rear that are used to explain the configuration and operation of the various components of the connector 1 are relative and not absolute. These expressions depend on the orientation of the device or its components as shown in the drawings, and thus will change when the orientation of the connector 1 or its components change.

One benefit of the embodiments depicted herein is the ability to provide a connector with a sheet that is able to suppress noise, suppress any adverse effects on signal integrity, eliminate radiation (side effects) from the sheet, reduce costs, increase durability, and improve reliability using a elegant structure. This can be accomplished by affixing to a housing a sheet with a laminate structure including a soft magnetic layer having real parts of complex relative permeability at 100 MHz that range from about 20 to 45 and a conductive/dielectric layer having an electrical resistance that can vary from 0.5 to 20 Ω·cm.

Looking at FIG. 1 a connector 1 with a sheet 41 is depicted. The connector 1 is mounted on one side of a substrate such as a printed circuit board, and can be mated with a flat cable 101 serving as the other connector, such as a flexible circuit board or a flexible flat cable. In other words, connector 1 can be used to establish an electrical connection with another connector such as conductive wiring in a flat cable 101. The flat cable 101 can also be a flat, flexible cable such as an FPC or FFC. It can be any type of flat cable with conductive wiring.

The connector 1 has a housing 11 integrally formed from a dielectric material such as a synthetic resin, and a plurality of terminals 61 integrally formed of a conductive material such as a metal, which are secured to the housing 11 and are electrically connected to the conductive wires in a flat cable 101. The dielectric material gives the housing an effective dielectric constant.

Figure 2A:
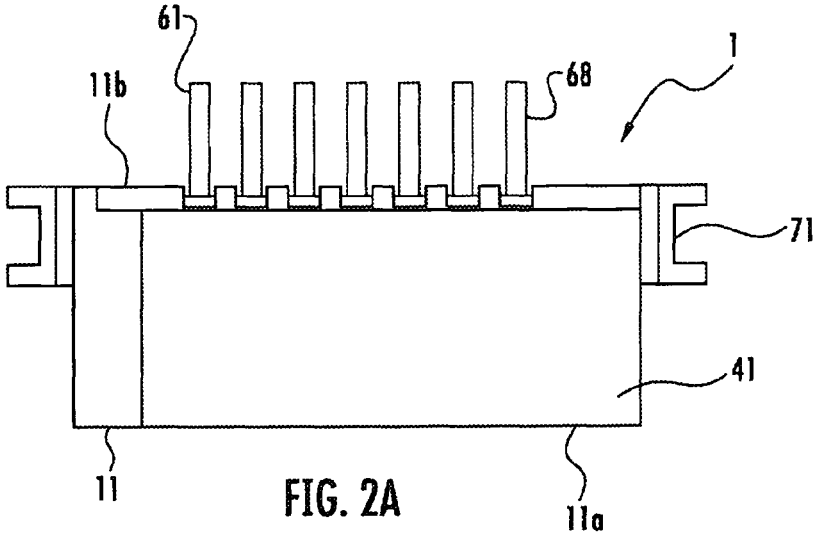
FIG. 2A shows a top view of the connector depicted in FIG. 1.
Figure 2B:
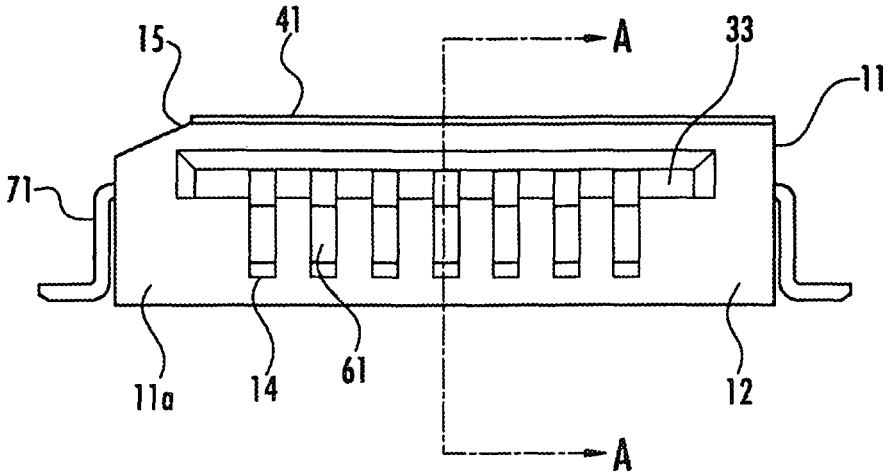
FIG. 2B shows an elevated front view of the connector depicted in FIG. 1
Figure 2C:
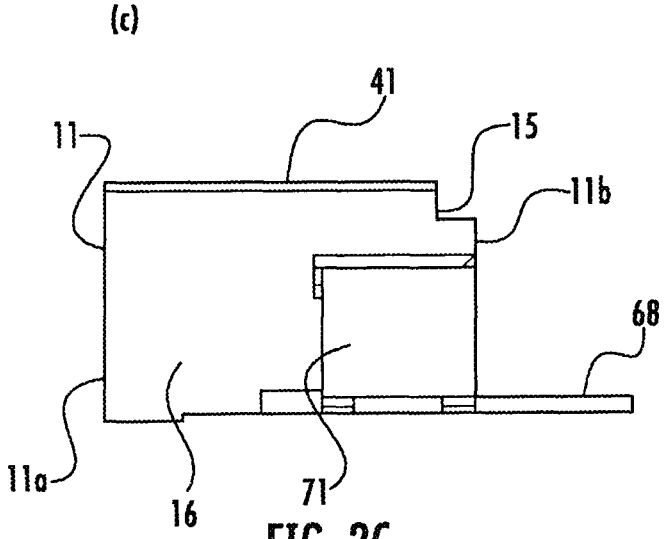
FIG. 2C shows an elevated side view of the connector depicted in FIG. 1.
Figure 2D:
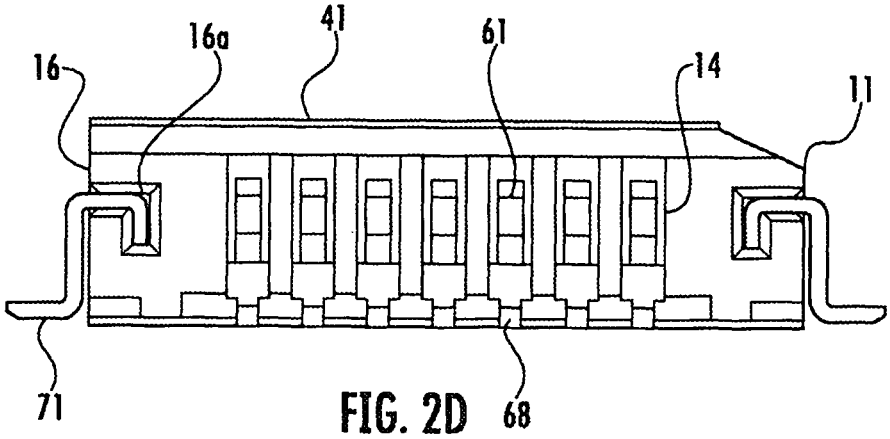
FIG. 2D shows an elevated rear view of the connector depicted in FIG. 1.

The housing 11 has a lower portion 12, an upper portion 15, left and right side portions 16, and an insertion opening 33 for inserting and mating the end of the flat cable 101 from the front (left in FIG. 2C). This opening is formed between the lower portion 12, the upper portion 15, and the side portions 16. The bottom face of the lower portion 12 is the mounting face opposing the surface of the substrate of the connector 1. In the present embodiment, the face at the entrance to the insertion opening 33, that is, the mating face, can be called the front face 11*a* of the connector 1 or housing 11, and the inner face of the insertion opening 33 can be called the rear face 11*b* of the connector 1 or the housing 11.

Figure 3A:
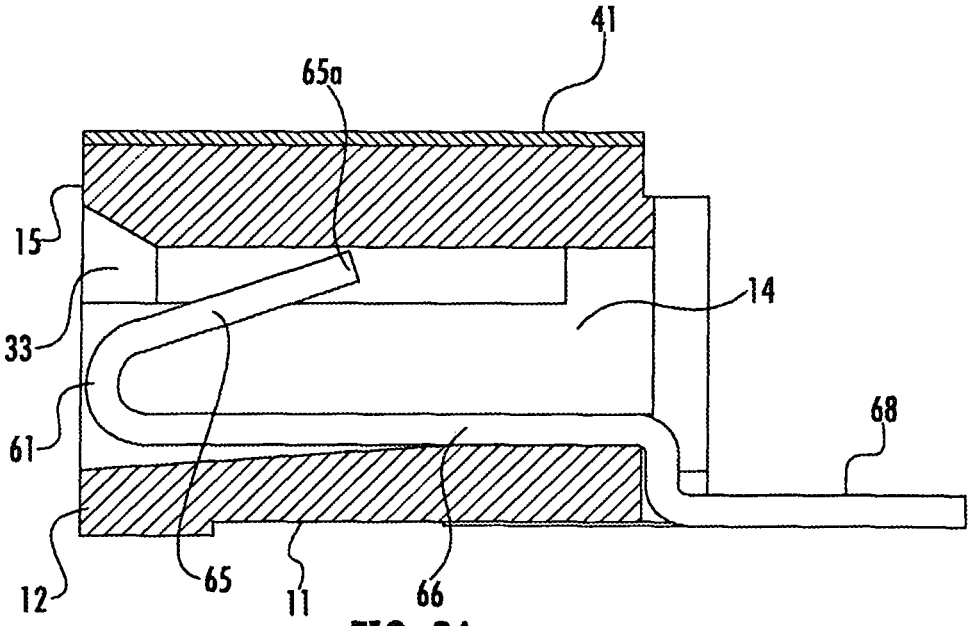
FIG. 3A shows cross-sectional view of the connector depicted in FIG. 2B, taken along line A-A in FIG. 2B.

There is a plurality of terminal receiving grooves 14 in the housing 11 for receiving the terminals 61. There can be, for example, a total of seven terminal receiving grooves 14 with an approximate pitch of 0.5 mm, and a single terminal 61 can be inserted into each terminal receiving groove 14. As shown in FIG. 3A, each terminal 61 has a main portion 66 extending longitudinally and secured inside the terminal receiving groove 14, an upper arm portion 65 extending to the rear at an angle from the front end of the main portion 66, and a tail portion 68 or board connector extending to the rear from the rear end of the main portion 66. A terminal 61 does not have to be inserted into all of the terminal receiving grooves 14. Terminals 61 can be left empty depending on the arrangement of the conductive wires in the flat cable 101.

The tail portion 68 extends to the rear from the rear face 11*b* of the housing 11, and the bottom face is secured by a conductive securing means such as solder to a connection pad, not shown in the drawing, which is formed on a face of the substrate. In this way, the terminals are connected electrically to conductive traces, not shown in the drawing, connected to the connection pads. The free end of the upper arm portion 65, that is, the tip, functions as a contact portion 65*a* making contact with the bottom face of the flat cable 101.

Also, the flat cable 101 has a substrate portion consisting of a slender band-shaped dielectric thin panel member, and a plurality of conductive wires not shown in the drawing which are disposed on one face of the substrate portion. The conductive wiring is thin strips of a conductive metal such as copper arranged in parallel at a predetermined pitch, for example, 0.5 mm. The surface of the conductive wiring is covered by a film-shaped insulating layer with electrical insulating properties. The insulating layer is removed for a predetermined length from the front end of the flat cable 101 to expose the conductive surface which functions as the other terminals. These are inserted into the insertion opening 33 so that the exposed face of the conductive wiring is on the bottom side.

The upper arm portion 65 is not restrained vertically inside the terminal receiving grooves 14 but can be displaced vertically. As a result, the free end of the upper arm portion 65 functions as a cantilevered spring member. With the upper arm portion 65 functioning as a spring member, the contact portion 65*a* can be displaced elastically in the vertical direction. Thus, the spring action of the upper arm portion 65 forces the contact portion 65*a* to apply pressure to the conductive wiring exposed on the bottom face of the flat cable 101 serving as the other terminals, and reliable contact is established with the conductive wiring.

An auxiliary mounting bracket 71 is mounted on the side portion 16 of the housing 11 to reliably mount the connector 1 on the substrate. The auxiliary mounting bracket 71 is preferably formed by punching or bending a metal sheet. The bottom face of the lower end functions as a connecting face connected to the face of the substrate and secured to the face of the substrate using a securing means such as solder so as to secure the housing 11 to the substrate. This anchors the housing to the substrate of the connector 1, and keeps the connector 1 from coming off the substrate. One end of the main portion of the auxiliary mounting bracket 71 is accommodated in and secured to an auxiliary bracket securing recessed portion 16*a* formed in a side portion 16 of the housing 11.

As depicted, the sheet 41 is affixed to the upper face of the upper portion 15 of the housing 11. Because the sheet 41 suppresses noise, it is preferably affixed where the most noise is generated, where the effect of noise is the greatest, and where the terminals 61 are connected to the other terminals. In order to make the affixing operation easier, the sheet 41 is preferably affixed to the outer face of the housing 11. The connector 1 is mounted on the surface of a substrate not shown in the drawing, and the flat cable 101 is inserted and mated. Therefore, it is difficult to affix the sheet 41 to the mounting face and mating face of the housing 11. As can be appreciated, the contact portion 65*a* of the terminal 61 contacts the conductive wiring of the flat cable 101 serving as the other connector near the upper portion 15 of the housing 11. Therefore, in the present embodiment, the sheet 41 is affixed to the upper face of the upper portion 15 of the housing 11.

Figure 3B:
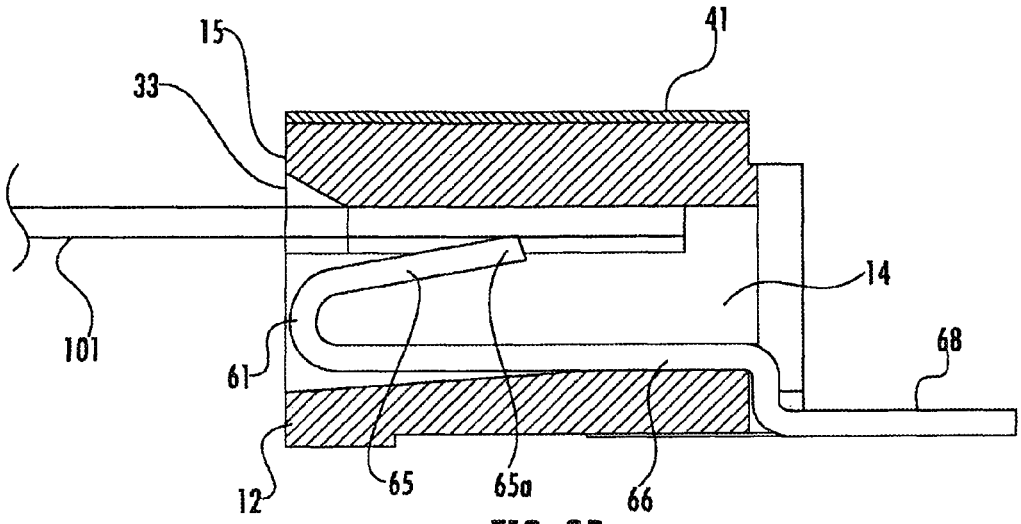
FIG. 3B shows the connector of FIG. 3A after a cable has been connected.

In the example shown in the drawings, the sheet 41 is affixed to the entire upper face of the upper portion 15. However, it does not have to cover the entire upper face of the upper portion 15. Instead, it can be used to cover the portion directly above the location where the terminals 61 make contact with the conductive wiring in the flat cable 101 serving as the other terminals. In other words, in the example shown in FIG. 3, the sheet 41 covers the range of the upper face of the upper portion 15 from the front end to the rear end. However, the sheet 41 can also cover the portion of the upper face of the upper portion 15 directly above where the conductive wiring exposed on the bottom face of the flat cable 101, which serves as the other terminals, makes contact with the contact portion 65*a*. In other words, the sheet 41 may be affixed to the upper face of the upper portion 15 so it covers at the portion directly adjacent the place where the terminals 61 make contact with the other terminals.

Also, the sheet 41 may be affixed to the side face of the side portions 16 and the rear face 11*b* in addition to the upper face of the upper portion 15. In other words, when the sheet 41 is affixed to the upper face of the upper portion 15 to cover at least the portion directly above where the terminals 61 come into contact with the other terminals, it can also be affixed in the other portions on the outer face of the housing 11 (excluding the mounting face and the mating face). In other words, in addition to being affixed to the portion directly above where the terminals 61 come into contact with the other terminals the sheet may also be affixed to the other portions of the outer face of the housing 11.

The following is a detailed explanation of the configuration of the sheet 41. The sheet 41 is an electromagnetic interference suppressive body in which a soft magnetic layer comprising a soft magnetic powder and a resin is laminated on a conductive/dielectric layer comprising a conductive filler and a resin. The electrical resistance of the conductive/dielectric layer is from 0.5 to 20 Ω·cm, and the real parts of the complex relative permeability of the soft magnetic layer at 100 MHz is from 20 to 45.

Figure 4:
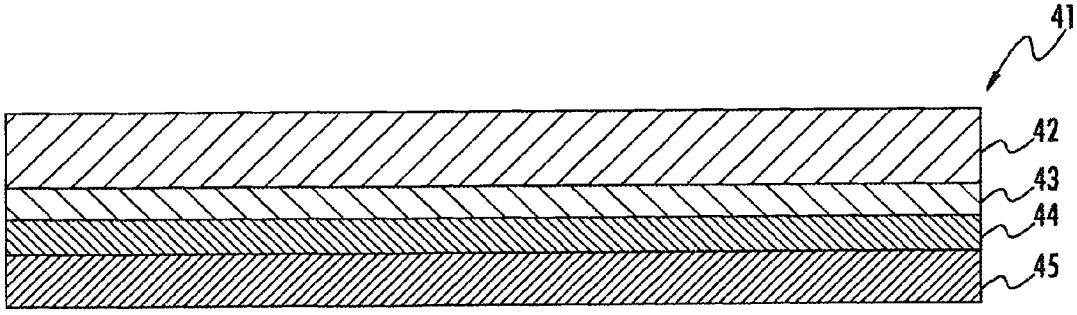
FIG. 4 is a schematic cross-sectional view showing the laminated structure of an embodiment of a sheet.

FIG. 4 is a schematic cross-sectional view showing the laminated structure of the sheet in the first embodiment of the present invention. As shown in the drawing, the sheet 41 has a two-layer structure in which a soft magnetic layer 42 and a conductive/dielectric layer 43 have been laminated. An adhesive layer 44 is added to the bottom of the conductive/dielectric layer 43, and release paper 45 is affixed to the bottom of the adhesive layer 44. The adhesive layer 44 is added to affix the sheet 41 to the outer face of the housing 11. The release paper 45 is added to keep the adhesive layer 44 from needlessly bonding to other portions, but this paper can be omitted if desired. Also, the thickness of the sheet 41 can be, for example, 100 μm, but this can be changed. The sheet 41 can be cut to any shape or size. In the present embodiment, the sheet has a two-layer structure with a soft magnetic layer and a conductive/dielectric layer. However, the sheet can have multiple soft magnetic layers and multiple conductive dielectric layers, but should have at least one soft magnetic layer and conductive/dielectric layer.

The soft magnetic layer 42 consists of a resin matrix (base material) filled with a magnetic material. The conductive/dielectric layer 43 consists of a resin matrix filled with a dielectric material. The matrix resin used in the soft magnetic layer 42 and the conductive/dielectric layer 43 is a thermosetting resin such as an epoxy resin, phenol resin, or polyester resin. The magnetic material in the soft magnetic layer 42 can be magnetite (magnetic iron ore), a ferrite such as Ni—Zn ferrite or Mn—Zn ferrite, or Sendust, silicon steel, or carbonyl iron. The dielectric material in the conductive/dielectric layer 43 can be carbon or graphite. The binder in the soft magnetic layer 42 and the conductive/dielectric layer 43 is a phenol resin adhesive with heat resistance of approximately 160 degrees Celsius (C) to help withstand the approximately 240 C temperatures in the reflow process when the connector 1 with an affixed sheet 41 is mounted on a substrate. When the heat-resistance temperature requirements are low, styrene-based thermoplastic elastomers, olefin-based thermoplastic elastomers, polyester-based thermoplastic elastomers, polyamide-based thermoplastic elastomers, urethane-based thermoplastic elastomers, and silicone-based elastomers can be used.

In the present embodiment, the soft magnetic layer 42 and the conductive/dielectric layer 43 are thermo-compression bonded so as to withstand the approximately 240 C temperatures in the reflow process when the connector 1 with an affixed sheet 41 is mounted on a substrate. However, the soft magnetic layer 42 and the conductive/dielectric layer 43 may be joined using any other method. For example, they may be joined using an adhesive (phenol resin-based adhesive, etc.).

Also, the depicted adhesive layer 44 can be made of an acrylic resin adhesive or an epoxy resin adhesive. An adhesive layer 44 made of an acrylic resin adhesive has a relatively low heat resistance of approximately 80 C, and a relatively weak bonding strength. However, the bonding strength differs from the face on the dielectric layer 43 side (the upper face in the drawing) and from the face applied to the housing 11 (the lower face in the drawing). The latter has a weaker bonding strength and easily peels off. An adhesive layer 44 made of a thermosetting resin adhesive such as an epoxy resin has a relatively high heat resistance of 160 C, which is able to withstand the approximately 240 C temperature in the reflow process. It also has a relatively strong bonding strength.

As shown in the drawings, the soft magnetic layer 42 and the conductive/dielectric layer 43 in the sheet 41 are arranged so that the soft magnetic layer 42 follows the conductive/dielectric layer 43 from the side with the adhesive layer 44 affixed to the outer face of the housing 11. In other words, when the sheet 41 is affixed to the outer face of the housing 11, the conductive/dielectric layer 43 is adjacent to the housing 11 made of a dielectric material, and the soft magnetic layer 42 is adjacent to the conductive/dielectric layer 43. The dielectric constant of the soft magnetic layer 42 at a frequency of 100 MHz has a real number portion μr' from 20 to 45, and the electrical resistance of the conductive/dielectric layer in the four probe method (JIS K 7194-1994) is from 0.5 to 20 Ω·cm.

The dielectric constant of the conductive/dielectric layer 43 can be configured so as to be higher than the effective dielectric constant of the housing 11. The real part of the dielectric constant (∈r') of the conductive/dielectric layer 43 can be from 50 to 160 when measured at a frequency of 1 GHz. The magnetic permeability and dielectric constant are determined by performing a concentric tube S parameter measurement of a donut-shaped object with an outer diameter of 7 mm, an inner diameter of 3 mm, and a thickness of from 1.4 to 2.5 mm.

A sheet 41 with this configuration can effectively suppress noise generated by the transmission of signals to the terminals 61 and the other terminals by affixing the sheet to the outer face of the housing 11 so as to cover at least the portion of the outer face of the housing 11 adjacent to the place where the terminals 61 come into contact with the other terminals. The sheet 41 does not need to be grounded and preferably is not grounded.

When a sheet is affixed in a signal transmission line, the reflection (S11) of transmitted signals and the electrical field strength and magnetic field strength near the housing have a tradeoff relationship. In other words, the impedance changes when a sheet is affixed to the housing, and this increases the reflection (S11). As a result, the transmission signals are attenuated. This, in turn, causes the electric field strength and magnetic field strength near the connector 1 to decrease. Therefore, an increase in S11 obstructs signal transmission. When a sheet of a finite size resonates with ¼th of the wavelength of the signals transmitted through the line, the affixed sheet causes antenna radiation, which increases the electric field strength and magnetic field strength near the connector. As a result of extensive research, it was determined that a connector structure which suppresses reflection (S11) to −10 dB or less, reduces the electric field strength and magnetic field strength, and suppresses antenna radiation.

Figure 5:
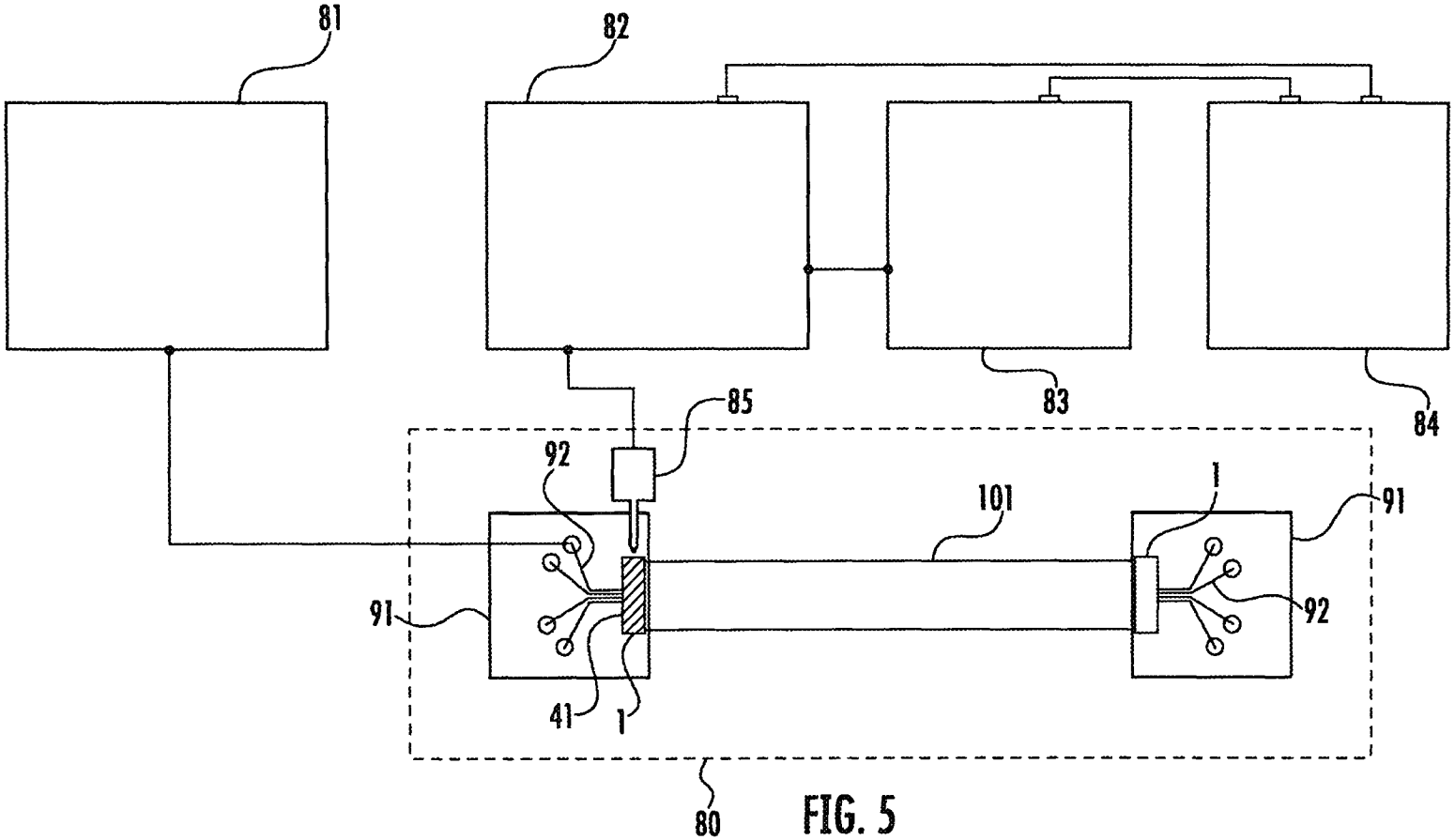
FIG. 5 is a schematic diagram used to explain a device for measuring the electric field strength and magnetic field strength near a connector with a sheet.
Figure 7A:
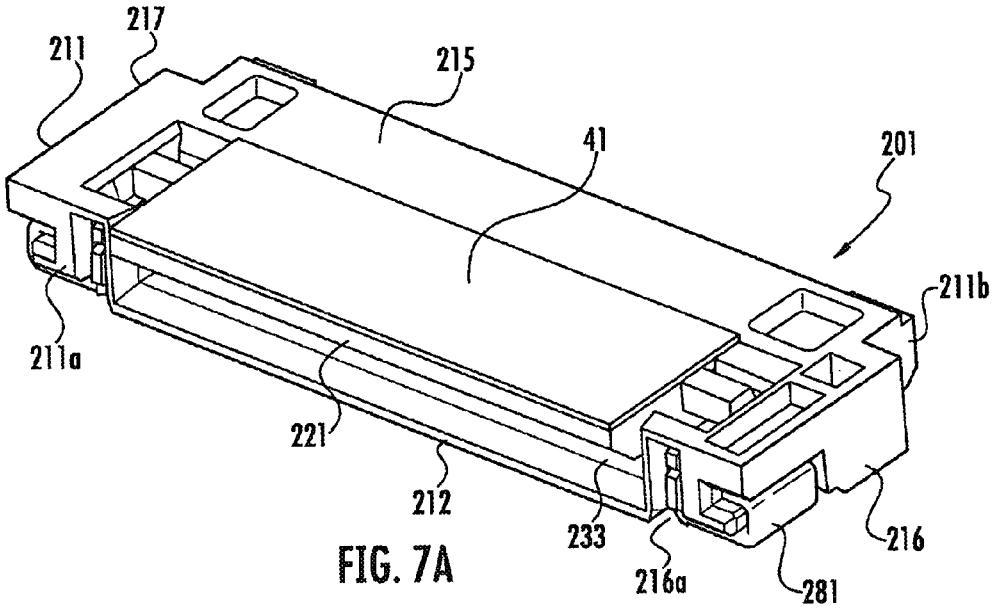
FIG. 7A shows a perspective view of an embodiment of a connector with a sheet
Figure 7B:
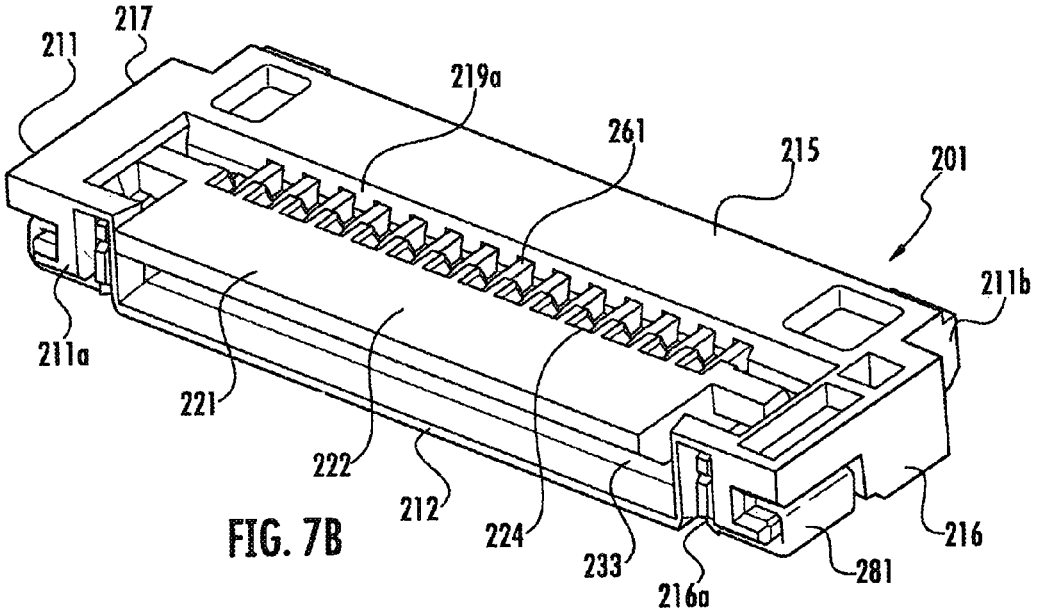
FIG. 7B shows the connector of FIG. 7A before the sheet has been applied.

The following is an explanation of an experimental example using this sheet 41. FIG. 5 is a diagram used to explain the device used to measure the electric field strength and magnetic field strength near a connector with a sheet according to the first embodiment of the present invention. FIG. 6 shows tables of the measured values for the connector with a sheet in the embodiment of the present invention. The device shown in FIG. 5 was used to measure the electric field strength near the connector 1 and the attenuation and reflection (S11) of the field strength when the sheet 41 was affixed to the top face of the upper portion 15 of the housing 11.

In this drawing, 80 is the inspected portion, which includes a pair of substrates 91, a connector 1 mounted on the surface of each substrate 91, and a flat cable 101 connected at both ends to each connector 1. A sheet 41 is affixed to the upper face of the upper portion 15 of the housing 11 in one of the connectors 1.

A signal generator 81 is connected to one conductive trace 92 of the substrate 91 connected, in turn, to the tail portion 68 of a terminal 61 in the connector 1. The signal generator 81 is a generator which generates signals at a predetermined frequency. This transmits signals at the predetermined frequency via the conductive trace 92, the terminal 61 connected to the conductive trace 92, and the conductive wire in the flat cable 101 in contact with the terminal 61.

The electric field strength and the magnetic field strength near the connector 1 are detected by a probe 85 and sent to the measuring device, which is an electromagnetic interference (EMI) tester 82. When the electric field strength and the magnetic field strength near the connector 1 with the affixed sheet 41 are compared to the electric field strength and the magnetic field strength near the connector 1 without an affixed sheet 41, the attenuation of the electric field strength and the magnetic field strength by the sheet 41 can be measured.

In addition, there is a spectrum analyzer 83 connected to the EMI tester 82, and the spectrum analyzer 83 can graph the frequency distribution of the electric field strength and magnetic field strength detected by the probe 85. In addition, there is a terminal device 84, which could be a personal computer, that is connected to the EMI tester 82 and the spectrum analyzer 83 and can control the operation of the EMI tester 82 and the spectrum analyzer 83, and can also store the data measured by the EMI tester 82 and the spectrum analyzer 83 in an appropriate drive.

In an embodiment, the sheet is manufactured by mixing conductive carbon fibers (referred to below simply as carbon fibers) with a styrene-based thermoplastic elastomer. For example, carbon fibers (fiber diameter: 1-2 μm; approximate length: 300 μm; specific gravity: 2.3) can be used. The conductive/dielectric sheet can be manufactured by adding the carbon fibers to a solution in which the styrene-based thermoplastic elastomer has been dissolved in the organic solvent cyclohexanone, and the fibers and solution are mixed together using a homomixer to obtain a liquid application. The liquid application is applied to polyester film to obtain a thickness of 30 μm after the solvent has dried. After the solvent has dried, low temperature and pressure molding can be performed (e.g., temperature of 120° C. and a pressure of 100 kg/cm$^2$). This can provide conductive/dielectric sheets having a thickness of 20 μm and different levels of electrical resistance such as 0.5 Ω·cm, 2.0 Ω·cm, 5.0 Ω·cm, 10.0 Ω·cm, and 14.0 Ω·cm. The quantity of conductive carbon fibers can be changed in order to change the electrical resistance.

A magnetic sheet can be manufactured by adding flaky weak magnetic metal powder (e.g., Fe—Si—Al alloy; average diameter: 40 μm; average thickness: 1 μm) to a solution in a manner as discussed above, and by mixing the powder with a styrene-based thermoplastic elastomer, and then applying, drying, and pressure-molding the solution magnetic sheets of the desired thickness and level of magnetism can be obtained. For example, a sheet could have a thickness of 80 μm. The quantity of flaky soft magnetic metal powder can be adjusted to change the complex relative permeability. For example, the real parts of the complex relative permeability μr' of the soft magnetic sheets at 100 MHz can be set at numbers such as 25, 30, or 40.

The sheets obtained by laminating these conductive/dielectric sheets and soft magnetic sheets were affixed to the upper portion of a conductive housing 11, and the electric field strength, magnetic field strength and reflection (S11) were measured.

FIGS. 6A and 6B shows the measurements of electric field strength, magnetic field strength and reflection (S11) when the laminated sheets 41 comprising a conductive/dielectric sheet and a soft magnetic sheet having the sheet configurations in Examples 1-5 and Comparative Examples 1-5 were affixed to a connector housing. In the provided measurements, the unit for attenuation based on a connector housing without a sheet affixed is decibels (dB), the negative sign (−) indicates the amount of attenuation, and a positive sign indicates antenna radiation. The unit of reflection (S11) is also decibels (dB).

As can be appreciated, in Example 1 a sheet 41 comprising a laminate of a conductive/dielectric sheet having a thickness of 20 μm and an electrical resistance of 14 Ω·cm and a soft magnetic sheet having a thickness of 80 μm and a permeability μr' at 100 MHz of 25 was affixed to the upper portion of a housing 11. Here, the electric field strength of 100 to 3,000 MHz near the housing was attenuated from 0 to −2.2 dB, the magnetic strength of 100 to 3,000 MHz was attenuated from 0 to −2.1 dB, and there was no antenna radiation in the entire frequency band. The reflection (S11) at 100 to 3,000 MHz was from −13.1 to −21.1 dB, and there were no problems with signal transmission.

In Example 2, a sheet 41 with a laminate of a conductive/dielectric sheet having a thickness of 20 μm and an electrical resistance of 5 Ω·cm and a soft magnetic sheet having a thickness of 80 μm and a permeability μr' at 100 MHz of 30 was affixed to the upper portion of a housing 11. Here, the electric field strength of 100 to 3,000 MHz near the housing was attenuated from −0.1 to −1.8 dB, the magnetic strength of 100 to 3,000 MHz was attenuated from −0.2 to −3.0 dB, and there was no antenna radiation in the entire frequency band. The reflection (S11) at 100 to 3,000 MHz was from −11.2 to −18.4 dB, and there were no problems with signal transmission.

In Example 3, a sheet 41 with a laminate of a conductive/dielectric sheet having a thickness of 20 μm and an electrical resistance of 10 Ω·cm and a soft magnetic sheet having a thickness of 80 μm and a permeability μr' at 100 MHz of 40 was affixed to the upper portion of a housing 11. Here, the electric field strength of 100 to 3,000 MHz near the housing was attenuated from 0 to −2.6 dB, the magnetic strength of 100 to 3,000 MHz was attenuated from 0 to −2.0 dB, and there was no antenna radiation in the entire frequency band. The reflection (S11) at 100 to 3,000 MHz was from −14.3 to −22.1 dB, and there were no problems with signal transmission.

In Example 4, a sheet 41 with a laminate of a conductive/dielectric sheet having a thickness of 20 μm and an electrical resistance of 2 Ω·cm and a soft magnetic sheet having a thickness of 80 μm and a permeability μr' at 100 MHz of 40 was affixed to the upper portion of a housing 11. Here, the electric field strength of 100 to 3,000 MHz near the housing was attenuated from −0.1 to −2.7 dB, the magnetic strength of 100 to 3,000 MHz was attenuated from 0 to −3.1 dB, and there was no antenna radiation in the entire frequency band. The reflection (S11) at 100 to 3,000 MHz was from −12.8 to −20.2 dB, and there were no problems with signal transmission.

In Example 5, a sheet 41 with a laminate of a conductive/dielectric sheet having a thickness of 20 μm and an electrical resistance of 0.5 Ω·cm and a soft magnetic sheet having a thickness of 80 μm and a permeability μr' at 100 MHz of 40 was affixed to the upper portion of a housing 11. Here, the electric field strength of 100 to 3,000 MHz near the housing was attenuated from −1.2 to −4.0 dB, the magnetic strength of 100 to 3,000 MHz was attenuated from −1.0 to −3.0 dB, and there was no antenna radiation in the entire frequency band. The reflection (S11) at 100 to 3,000 MHz was from −10.4 to −19.3 dB, and there were no problems with signal transmission. Thus, examples 1-5 all provide desirable results.

Comparative Example 1 provided a conductive metal foil of copper having a thickness of 20 μm that was affixed to the upper portion of a housing 11, and the electric field strength near the housing, the magnetic field strength and the reflection (S11) were measured. The reflection S11 at 100 to 3,000 MHz was from −1.6 to −8.7 dB. Because this is too high, signal integrity was unsatisfactory. Comparative Example 2 provided conductive metal foil of copper having a thickness of 20 μm was affixed to the upper portion of a housing 11 in the same manner as comparative example 1 but the copper foil was grounded, and the electric field strength near the housing, the magnetic field strength and the reflection (S11) were measured. The measured reflection S11 at 100 to 3,000 MHz was from −2.7 to −18.5 dB. The ground connection did provide a benefit but the reflection (S11) was still too high, and signal integrity was poor.

Comparative Example 3 used a conductive/dielectric sheet containing a larger amount of conductive carbon fibers so as to provide a sheet having a thickness of 30 μm and an electrical resistance of 0.3 Ω·cm was affixed to the upper portion of the housing 11, and the electric field strength near the housing, the magnetic field strength and the reflection S11 were measured. The reflection S11 at 100 to 3,000 MHz was from −5.3 to −13.1 dB and, similar to the results in the first and second comparative examples, signal integrity was poor.

Comparative Example 4 used a conductive/dielectric sheet of the fifth example (but without the soft magnetic sheet layer) having a thickness of 20 μm was affixed to the upper portion of the housing 11, and the electric field strength near the housing, the magnetic field strength and the reflection S11 were measured. The reflection S11 was from −7.9 to −9.2 dB and, as in the first and second comparative examples, signal integrity was poor.

Comparative Example 5 used a soft magnetic sheet containing a larger amount of flaky weak magnetic metal powder (Fe—Si—Al alloy; average diameter: 40 μm; average thickness: 1 μm) (but without a conductive/dielectric sheet) having a thickness of 100 μm and real parts of the complex relative permeability μr' at 100 MHz of 100 was affixed to the upper portion of the housing 11, and the electric field strength near the housing from 100 to 3,000 MHz, the magnetic field strength and the reflection S11 were measured. The reflection S11 was from −12.7 to −19.3 dB, the electrical field strength near the housing was from 0.6 to −4.4, and the magnetic field strength near the housing was from 1.7 to −6.0. There was magnetic radiation at 3,000 MHz.

The characteristics of the sheets are shown in FIG. 6A-6B. The sheets using the preferred construction had electrical field strength (3,000 MHz) attenuation from −0.7 to −4.0 dB, and magnetic field strength attenuation from −1.4 to −3.0 dB. In other words, there was attenuation of both the electrical field and the magnetic field. However, the reflection S11 was less than −15.0 db, representing a beneficial balance. As can be appreciated, the laminate sheets can thus reliably suppress noise while minimizing adverse effects on signal integrity using an elegant structure. The number of laminated sheets and the thickness of each sheet can be adjusted in order to change the performance level and the suppressed frequencies. Also, the cost of connector can be reduced while its durability and reliability are improved.

In an embodiment the sheet 41 is laminated so that the dielectric layer 43 is adjacent to the housing 11, and the magnetic layer 42 is adjacent to the dielectric layer 43. As a result, the electric field strength and the magnetic field strength near the connector can be effectively attenuated, and noise can be reliably suppressed. In addition, the sheet 41 is affixed to the outer face of the housing 11 so as to cover at least the portion directly above where the terminals 61 come into contact with the conductive wiring serving as the other terminals. In this way, the sheet 41 can be positioned near where the terminals 61 make contact with the conductive wiring. Such locations are where noise is more likely to be generated and such a positioning of the sheet can be used to effectively suppress the noise.

As can be appreciated, the sheet 41 can be affixed to the outer face of the housing, and the outer face can be different than the mating face and the mounting face. In this way, the sheet 41 can be easily affixed, and the cost of the connector can be reduced. Also, the housing 11 is made of a dielectric material, and the dielectric constant of the dielectric layer 43 can be higher than the dielectric constant of the housing 11. In this way, the electric field strength near the connector. 1 can be effectively attenuated, and noise can be more reliably suppressed.

FIGS. 7A-9 illustrates views of a second embodiment of a connector with a sheet. A connector 201 is mounted on one side of a substrate such as a printed circuit board and, as in the first embodiment, can be mated with a flat cable 101 serving as the other connector. The connector 201 has a housing 211 integrally formed from a dielectric material such as a synthetic resin, and a plurality of terminals 261 integrally formed of a conductive material such as a metal, which are electrically connected to the conductive wires in the flat cable 101. The housing 211 includes a fixed housing main portion 217, and an actuator 221 mounted to the housing main portion 217 so as to be able to change orientation. In other words, the actuator 221 is mounted on the housing main portion 217 so as to rotate and change orientation, the first position being the open position and the second position being the closed position.

Figure 8A:
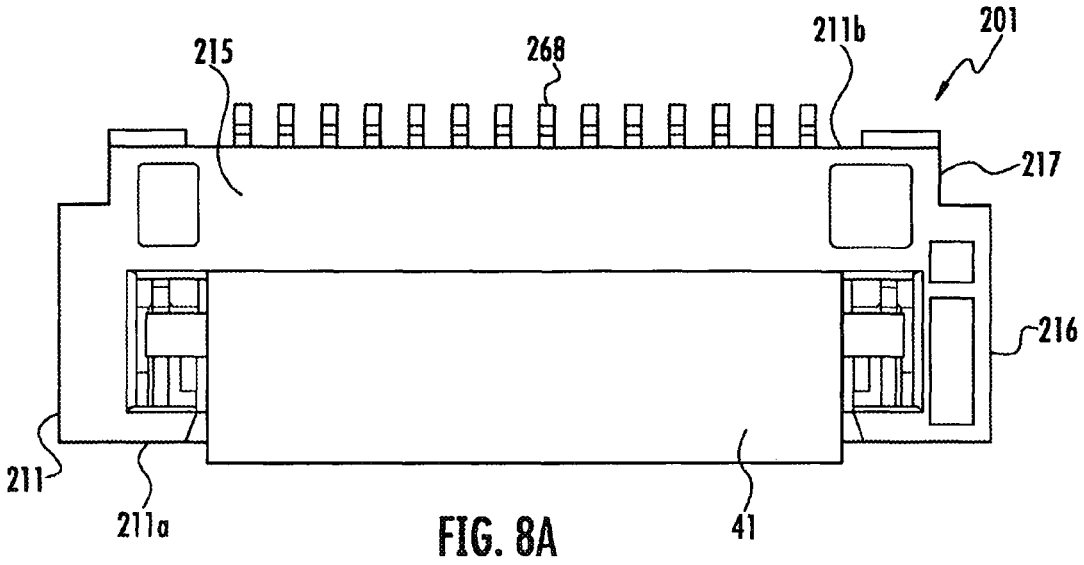
FIG. 8A shows a top view of another embodiment of a connector with a sheet.
Figure 8B:
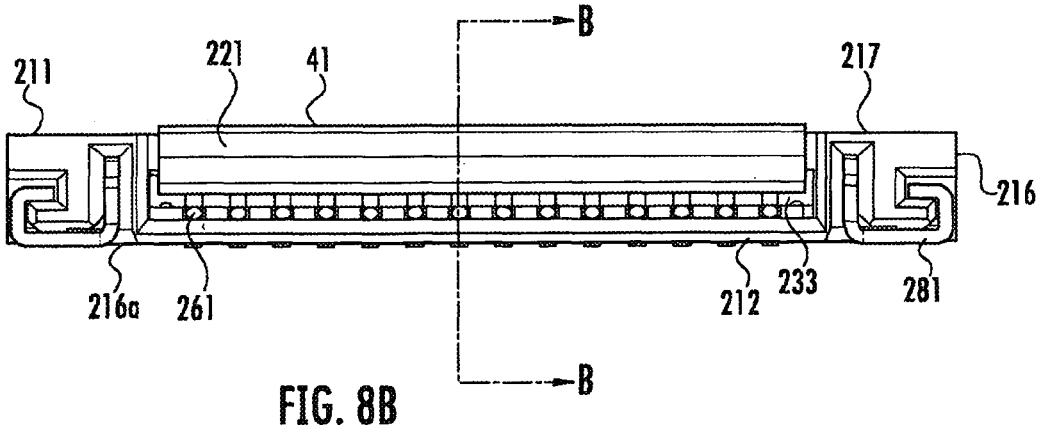
FIG. 8B shows an elevated front view of the embodiment depicted in FIG. 8A.
Figure 8C:
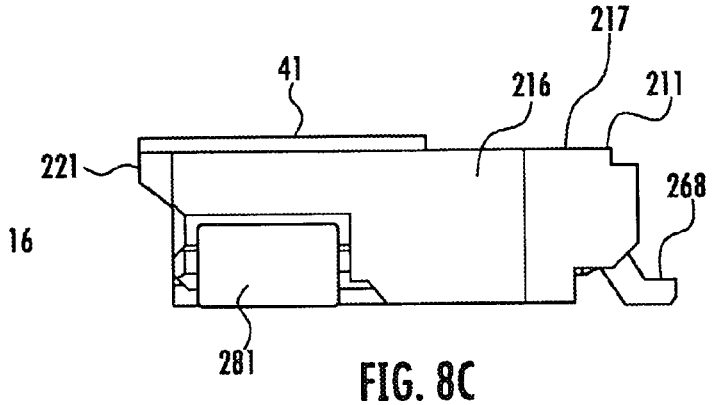
FIG. 8C shows an elevated side view of the embodiment depicted in FIG. 8A.
Figure 10A:
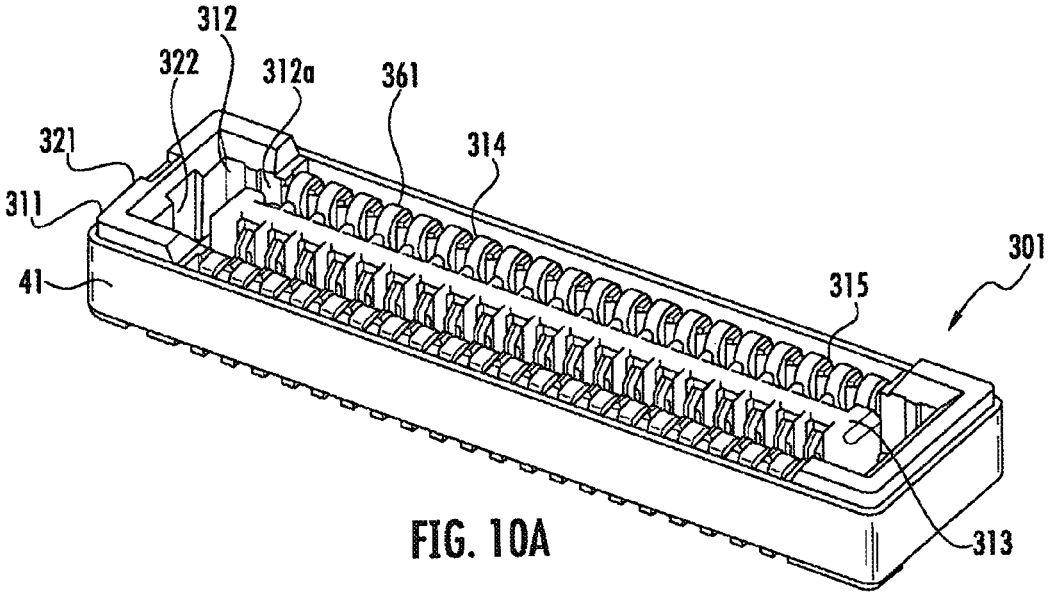
FIG. 10A shows a perspective view of another embodiment of a connector with a sheet.

The housing main portion 217 has a lower portion 212, an upper portion 215, left and right side portions 216, and an insertion opening 233 for inserting and mating the end of the flat cable 101 from the front (left in FIG. 8 (*c*)). This opening is formed between the lower portion 212, the upper portion 215, and the side portions 216. The bottom face of the lower portion 212 is the mounting face opposing the surface of the substrate of the connector 201. In the present embodiment, the face at the entrance to the insertion opening 233, that is, the mating face, can be called the front face 211*a* of the connector 201 or housing 211, and the inner face of the insertion opening 233 can be called the rear face 211*b* of the connector 201 or the housing 211.

There is a plurality of terminal receiving grooves 214 in the housing main portion 217 for receiving the terminals 261. There can be, for example but without limitation, a total of 14 terminal receiving grooves 214 with an approximate pitch of 0.5 mm, and a single terminal 261 can be inserted into each terminal receiving groove 214. A terminal 261 does not have to be inserted into each of the terminal receiving grooves 214. Terminals 261 can be left empty depending on the arrangement of the conductive wires in the flat cable 101.

A slit-shaped auxiliary bracket accommodating recessed portion 216*a* extending in the insertion direction of the flat cable 101 is formed in a side portion 216 of the housing main portion 217, and an auxiliary mounting bracket 281 is inserted into the auxiliary bracket accommodating recessed portion 216*a* and mounted to the housing 211 in order to reliable mount the connector 1 on the substrate. The auxiliary mounting bracket 281 preferably is formed by punching or bending a metal sheet. The bottom face of the lower end functions as a connecting face connected to the face of the substrate and secured to the face of the substrate using a securing means such as solder so as to secure the housing 211 to the substrate. This anchors the housing to the substrate of the connector 201, and keeps the connector 201 from coming off the substrate.

The actuator 221 has an actuator trunk portion 222, which is a thick rectangular panel, and a pressure applying portion 223 formed on the bottom face of the actuator trunk portion 222. The pressure applying portion 223 presses down the flat cable 101 inserted into the insertion opening 233, that is, applies pressure in the direction of the lower portion 212, when the actuator 221 is in the closed position. When the actuator 221 is in the closed position, the bottom face of the pressure applying portion 223 is the cable pressure applying face, which comes into contact with the upper face of the flat cable 101 inserted into the insertion opening 233, that is, the face on the opposite side from the exposed conductive wiring. The pressure applying portion 223 enables the flat cable 101 to be inserted or removed when the actuator 221 is in the open position.

Figure 9:
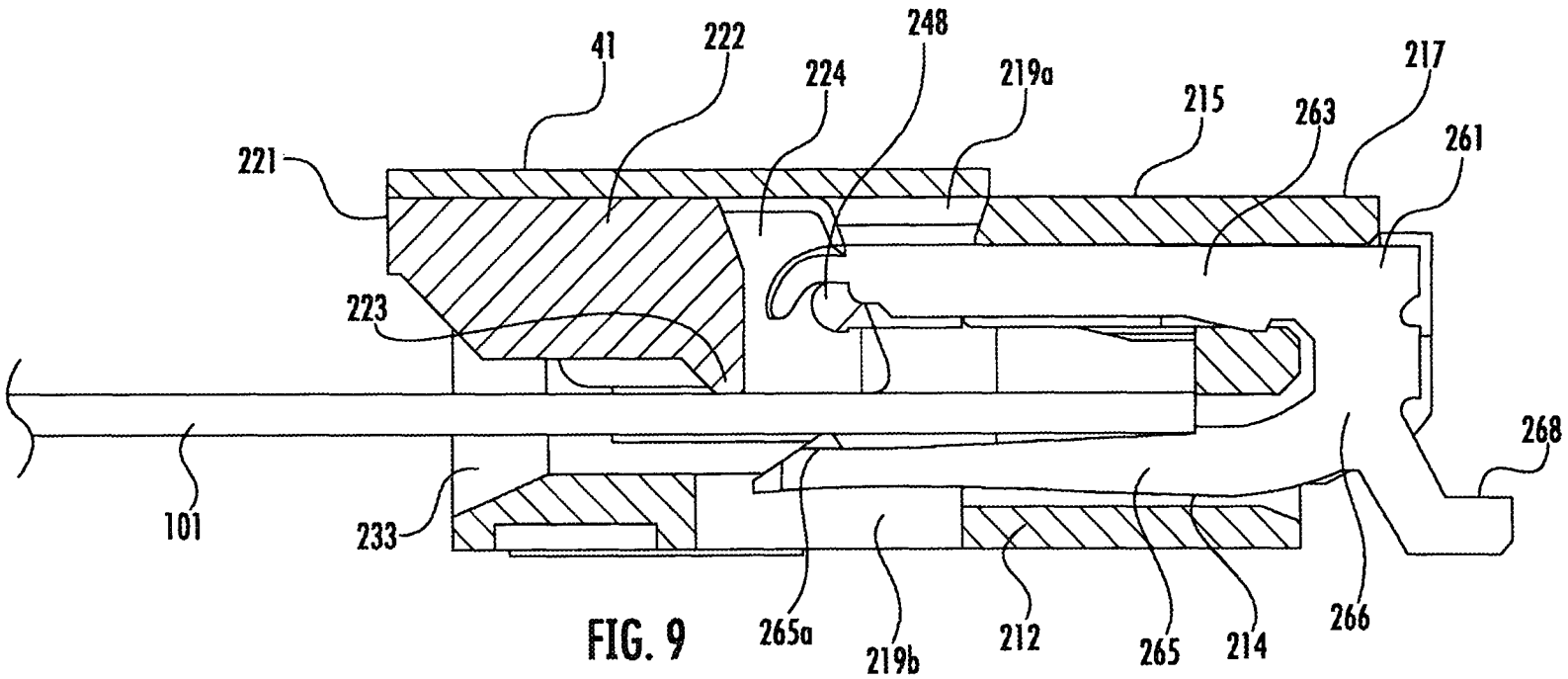
FIG. 9 shows a cross-sectional view of the connector in FIG. 8B, taken along the line B-B.
Figure 10B:
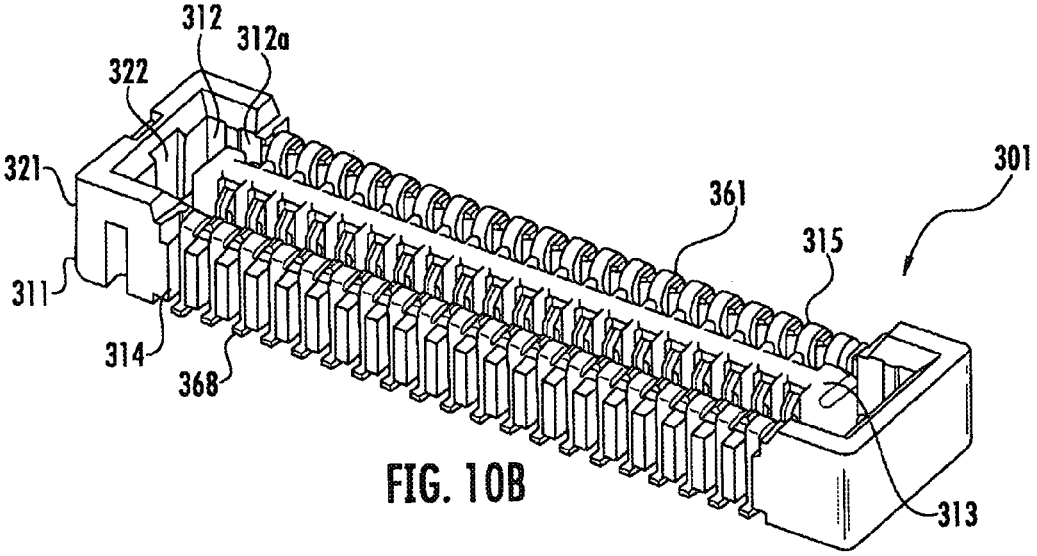
FIG. 10B shows a perspective view of the connector of FIG. 10A with the sheet removed.
Figure 11A:
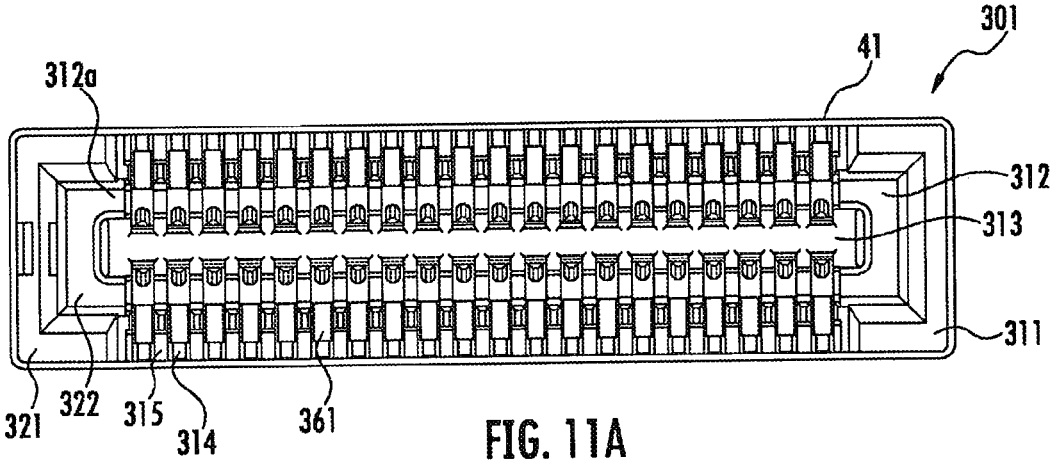
FIG. 11A shows a top view of another embodiment of a connector with a sheet.
Figure 11B:
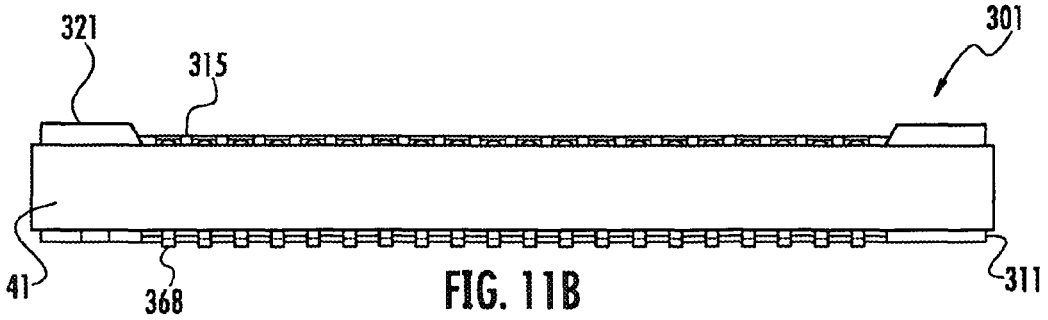
FIG. 11B shows an elevated front view of the embodiment depicted in FIG. 11A.
Figure 11C:
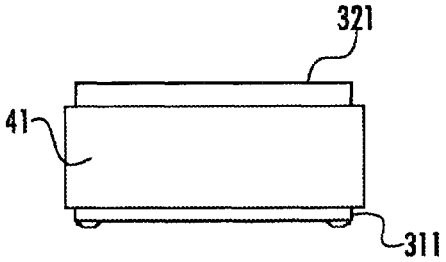
FIG. 11C shows an elevated side view of the embodiment depicted in FIG. 11A.

A plurality of accommodating grooves 224 for accommodating the upper arm portion 263 of each terminal 261 is formed in the rear end side of the pressure applying portion 223 (the right end side in FIG. 9). The number and arrangement of accommodating grooves 224 depends on the terminal receiving grooves 214. The actuator 221 also has a shaft portion 248 extending in the width direction and connecting to the pressure applying portion 223 so as to transect each accommodating groove 224. The portion of the shaft portion 248 located inside each receiving groove 224 engages the upper arm portion 263 of a terminal 261.

The terminals 261 are formed by punching a metal sheet, and are arranged in a row in the width direction of the housing 211. Each terminal 261 has a main portion 266 positioned at the rear end and extending vertically, an upper arm portion 263 functioning as an actuator holding arm portion extending forward from the front end of the main portion 266, a tail portion 268 as a substrate connecting portion extending downward from the bottom end of the main portion 266, and a lower arm portion 265 extending forward from the bottom end of the main portion 266.

The lower arm portion 265 is arranged so as to face the upper arm portion 263. A contact portion 265*a* is formed at the tip or free end of the lower arm portion 265 which establishes contact with the conductive wiring in the flat cable 101 when the actuator 221 is in the closed position. Also, the rear end of the lower arm portion 265 is not restrained by the main portion 266, and the tip or free end functions as a cantilevered spring member.

As shown in FIG. 9, the housing lower portion opening 219*b*, which is an opening passing through the lower portion 212 in the thickness direction, is formed in the lower portion 212 of the housing main portion 217 in a section corresponding to the tip of the lower arm portion 265. Thus the tip of the lower arm portion 265 is not restrained but is able to be displaced vertically. Because the contact portion 265 applies pressure to the conductive wiring of the flat cable 101 due to the spring action of the lower arm portion 265, contact with the conductive wiring is reliably maintained.

The housing upper portion opening 219*a* is a gap formed between the upper portion 215 of the housing main portion 217 and the actuator trunk portion 222 of the actuator 221 in the closed position. The housing upper portion opening 219*a* is positioned so as to substantially correspond to the housing lower portion opening 219*b* in the longitudinal direction of the housing 211. Therefore, when the actuator 221 is in the closed position, the housing upper portion opening 219*a* and the housing lower portion opening 219*b* are positioned above and below the contact portion 265*a* and released in the terminal receiving groove 214 corresponding to each terminal 261. In other words, the housing 211 is no longer above and below the terminals 261 and the conductive wiring of the flat cable 101 serving as the other terminals.

As can be appreciated, the sheet 41 is affixed to the upper face of the actuator trunk portion 222 of the actuator 221 including the housing 211, and the protruding portion extending to the rear from the upper face of the actuator trunk portion 222 is covered so as to seal the housing upper portion opening 219*a*. Because the sheet 41 is a noise suppressing member, it is preferably affixed near the contact point between the terminals 261 and the other terminals, which is where the most noise is generated. In order to make the affixing operation easier, the sheet 41 is preferably affixed to the outer face of the housing 211. The connector 201 is mounted on the surface of a substrate not shown in the drawing, and the flat cable 101 is inserted and mated. Therefore, it is difficult to affix the sheet 41 to the mounting face and mating face of the housing 211. As can be seen in FIG. 9, the contact portion 265*a* of the terminal 261 contacts the conductive wiring of the flat cable 101 serving as the other connector in a position corresponding to the housing upper portion opening 219*a*. Therefore, as depicted the sheet 41 is affixed to the upper face of the actuator trunk portion 222 so as to cover the housing upper portion opening 219*a*.

As depicted, the sheet 41 is affixed to the upper face of the actuator trunk portion 222 of the actuator 221 but it can also be affixed to the upper face of the upper portion 215 of the housing main portion 217. Also, the protruding portion extending forward from the upper face of the upper portion 215 can be arranged so as to cover the housing upper portion opening 219*a*. In other words, the sheet 41 can cover the portion directly above the location where the terminals 261 come into contact with the conductive wiring of the flat cable 101 serving as the other terminals. This means the sheet 41 may be affixed to the outer face of the housing 211 so as to cover at least the portion directly above where the terminals 261 come into contact with the other terminals.

As depicted, connector 201 has a housing 211 mated with a flat cable 101, terminals 261 secured to the housing 211 and contacting the conductive wiring in the flat cable 101 serving as the other terminals, and a sheet 41 affixed to the housing 211. The sheet 41 has a laminate structure with a magnetic layer 42 and a dielectric layer 43. This elegant configuration is able to reliably suppress noise and suppress adverse effects on signal integrity. The resulting connector 201 can be made in a cost effective manner and has improved durability and reliability.

FIGS. 10A-13B illustrate views of a third embodiment of a connector with a sheet. A connector 301 is mounted on one side of a substrate such as a printed circuit board, and can be mated with a substrate-to-substrate connector serving as the other connector. In other words, it is used to establish an electrical connection with another connector 401, which is the connector at the other end of the connection between substrate-to-substrate connectors. The connector 301 has a housing 311 integrally formed from a dielectric material such as a synthetic resin, and a plurality of terminals 361 integrally formed of a conductive material such as a metal, which are electrically connected to the terminals 461 of the other connector 401.

As shown in the drawing, the housing 311 has a substantially rectangular and elongated panel shape (although other shapes are also suitable), and an elongated recessed portion 312 is formed on the insertion side, that is, mating side for the other connector 401. A convex portion 313 serving as an island is integrally formed with the housing 311 inside the recessed portion 312, and a side wall portion 315 extending parallel to the convex portion 313 is integrally formed with the housing 311 on both sides of the convex portion 313. Here, the convex portion 313 and the side wall portions 315 protrude upward from the bottom face of the recessed portion 312, and extend in the length direction of the housing 311. In this way, a recessed groove portion 312*a*, which is a slender insertion recessed portion extending in the length direction of the housing 311, is formed between the convex portion 313 and the side wall portions 315 as a portion of the recessed portion 312 on both sides of the convex portion 313. There is a single convex portion 313 in the example shown in the drawing, but there can be a plurality of convex portions as well.

A terminal accommodating cavity 314, which is recessed, is formed on both side faces of the convex portion 313, and the terminal accommodating cavity 314 is formed in the side wall portion 313 so as to straddle the upper face and the side faces. The terminal accommodating cavity 314 formed in the convex portion 313 and the terminal accommodating cavity 314 formed in the side wall portion 315 are joined together on the bottom face of the recessed groove portion 312*a* and integrated.

For example, without limitation, twenty terminal accommodating cavities 314 can be formed on both the left and right sides at an approximate pitch of 0.4 mm. A terminal 261 does not have to be inserted into each terminal accommodating cavity 314. Some terminals 361 can be omitted depending on the arrangement of the other terminals 461. Each terminal 361 is integrally formed by punching or bending a conductive metal strip, and has a main portion 366, a tail portion 368 connected to the bottom end of the main portion 366, an upper arm portion 363 connected to the upper end of the main portion 366, and a lower arm portion 365 connected to the upper arm portion 363.

The main portion 366 extends in the vertical direction, that is, in the thickness direction of the housing 311, and is inserted and held by a terminal accommodating cavity 314 formed on the side wall portion 315. The tail portion 368 is bent towards the main portion 366 and connected, and is connected by solder to a connection pad connected, in turn, to a conductive trace on the substrate. The lower arm portion 365 is bent downward to the inner end of the upper arm portion 363 and has a U-shaped lateral shape. A first contact portion 365*a*1 is formed in the tip or free end of the lower arm portion 365 to be a contact portion making contact with another terminal 461 when mated with another connector 401. Also, a second contact portion 365*a*2 is formed opposite the first contact portion 365*a*1 on the base end of the lower arm portion 365, that is, the end portion on the side connected to the upper arm portion 363. This serves as a contact portion, which makes contact with another terminal 461 when mated with another connector 401.

Because the terminals 361 are integrally formed by working metal strips, they are fairly elastic. As should be clear from the shape of the lower arm portion 365, the interval between the opposing first contact portion 365*a*1 and second contact portion 365*a*2 can be changed elastically. When another terminal 461 on another connector 401 is inserted between the first contact portion 365*a*1 and the second contact portion 365*a*2, the interval between the first contact portion 365*a*1 and the second contact portion 365*a*2 is elastically extended.

A protruding end portion 321 is provided as a mating guide portion on both ends of the housing 311 in the length direction. A protruding end recessed portion 322 is formed as a part of the recessed portion 312 in each protruding end portion 321. The protruding end recessed portions 322 are elongated recessed portions, and are connected to both ends of each recessed groove portion 312*a* lengthwise. The protruding end recessed portions 322 function as guide recessed portions into which another protruding end portion 422 of another connector 401 is inserted when the connector 301 is mated with another connector 401.

As depicted, the sheet 41 is affixed to the outer side face of the side wall portion 315 and the protruding end portions 321 of the housing 311, and the entire face of the housing 311 is covered. In other words, it is affixed to the entire side face except for the mating face and the mounting face of the connector 301. As is clear from a comparison of FIG. 10A and FIG. 10B, the terminal accommodating cavities 314 formed in the outer side face of the side wall portion 315, and the main portion 366 of the terminals 361 accommodated inside the terminal accommodating cavities 314 are covered by a sheet 41.

The other connector 401 has a housing 411 integrally made of a dielectric material such as a synthetic resin, and a plurality of terminals 461 integrally made of a conductive material such as a metal and connected electrically to the terminals 361 of the connector 301.

Figure 12A:
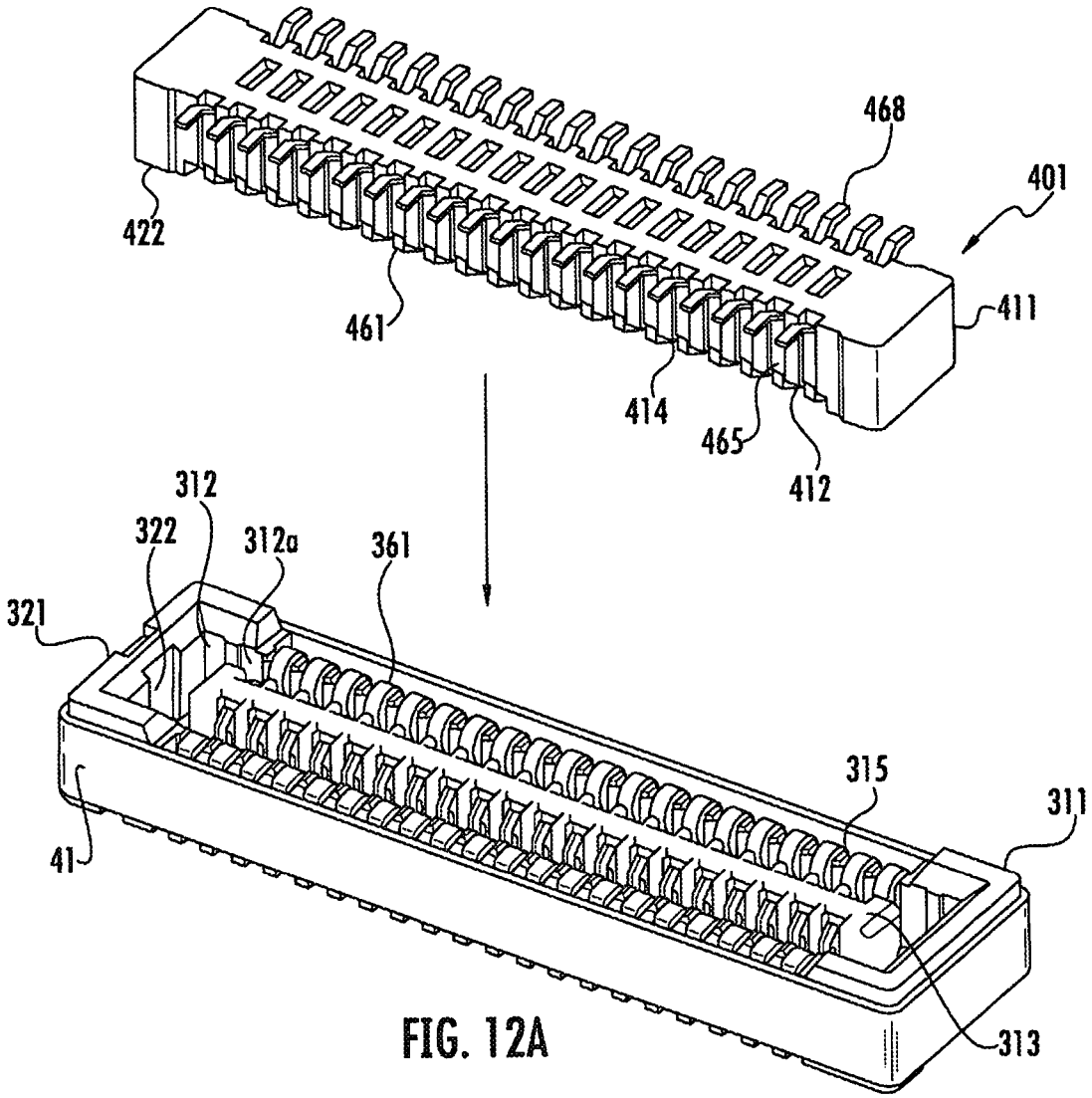
FIG. 12A shows a perspective exploded view of two connectors.

As can be appreciated from FIG. 12A, the housing 411 has a substantially elongated rectangular shape, and includes an integrally molded slender recessed groove portion 413 extending in the length direction of the housing 411 on the side inserted into and mated with the connector 301 and an integrally molded convex portion 412 as a slender insertion convex portion defining the outside of the recessed groove portion 413 and extending in the length direction of the housing 411. A convex portion 412 is formed along both sides of the recessed groove portion 413 and along both sides of the housing 411. A terminal 461 is provided in each convex portion 412. The recessed groove portions 413 are sealed on the side mounted on the substrate, that is, on the mounted side. In the example shown in the drawing, there are two convex portions 412. However, there can also be one, or more than two.

A terminal accommodating cavity 414 is formed on the convex portion 412 so as to straddle both side faces and the upper face, and a terminal 461 is accommodated inside each terminal accommodating cavity 414. For example, twenty terminal accommodating cavities 414 can be formed on both the left and right sides of the recessed groove portion 413 at an approximate pitch of 0.4 mm. A terminal 461 does not have to be inserted into each terminal accommodating cavity 414. Some terminals 461 can be omitted depending on the arrangement of the other terminals 361. The terminals 461 are integrally formed by punching or bending conductive metal strips, and include a main portion 466 functioning as the second connection portion, a tail portion 468 connected to the bottom end of the main portion 466, and an arm portion 465 connected to the upper end of the main portion 466.

The main portion 466 extends in the vertical direction, that is, in the thickness direction of the housing 411, and is inserted and held by a terminal accommodating cavity 414. The tail portion 468 is bent towards the main portion 466 and connected, and is connected by solder to a connection pad connected, in turn, to a conductive trace on the substrate. The arm portion 465 is bent towards the main portion 466 and connected so as to have an L-shaped lateral shape. The first connection portion 365*a*1 of the terminal 361 makes contact with the arm portion 465.

A protruding end portion 422 is provided as a mating guide portion on both ends of the housing 411 in the length direction. A protruding end recessed portion 422 extends in the short axis direction of the housing 411, and both ends are thick members connected to both ends of a convex portion 412 in the length direction. The upper face has a substantially rectangular planar face. The protruding end portion 422 is inserted into the protruding end recessed portion 322 of the protruding end portion 321 of the connector 301, when connector 301 is mated with the other connector 401. A sheet 41 is not affixed to the other housing 411.

Figure 12B:
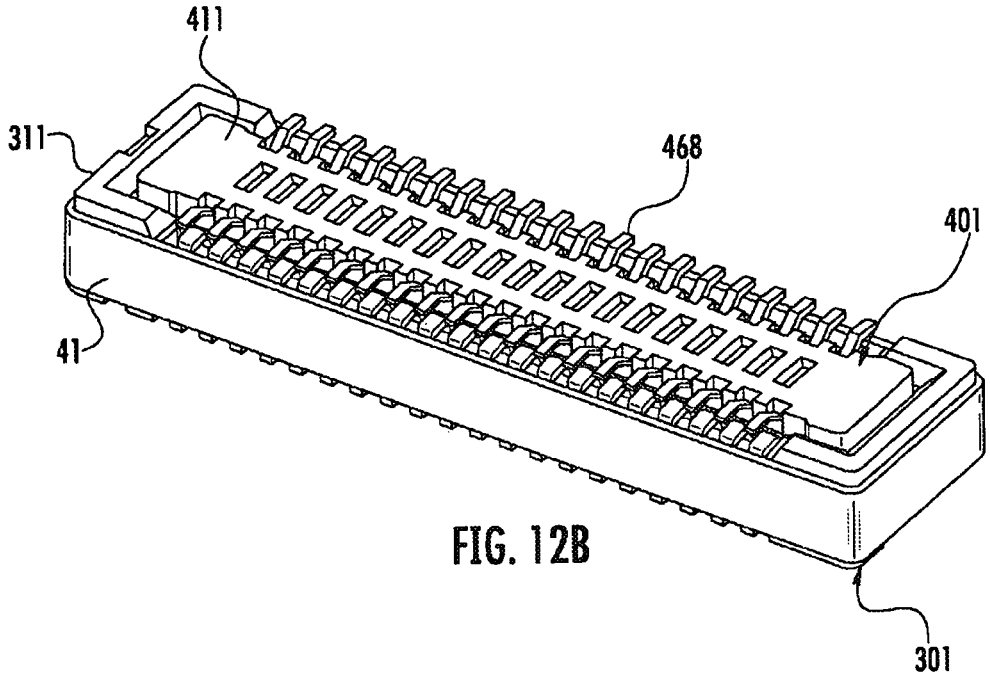
FIG. 12B shows a perspective view of the two connectors of FIG. 12A mated with each other.
Figure 13A:
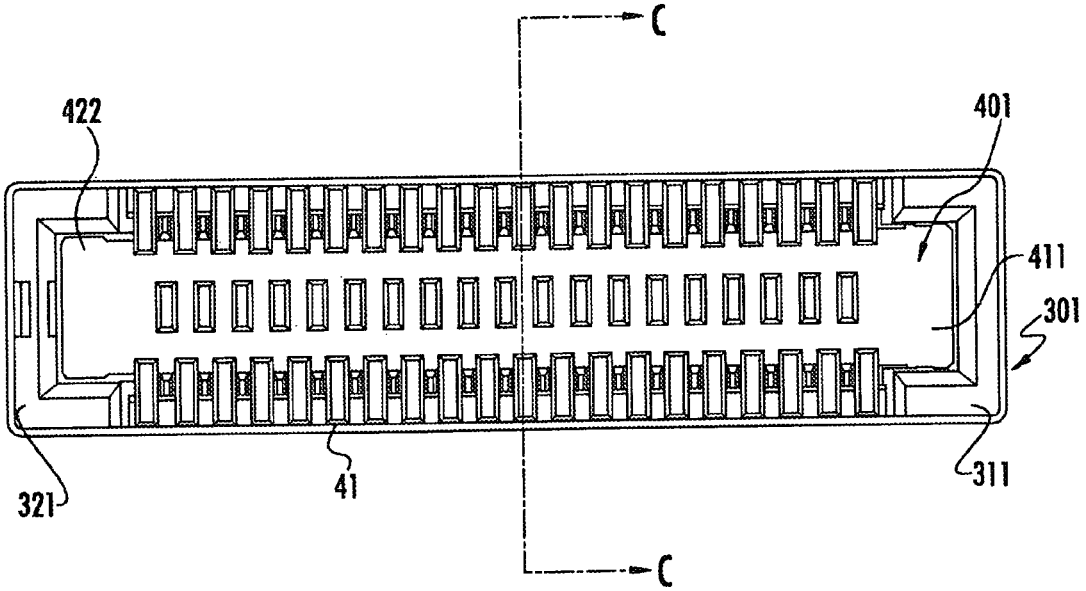
FIG. 13A shows a top plan view of the embodiment depicted in FIG. 12B.
Figure 13B:
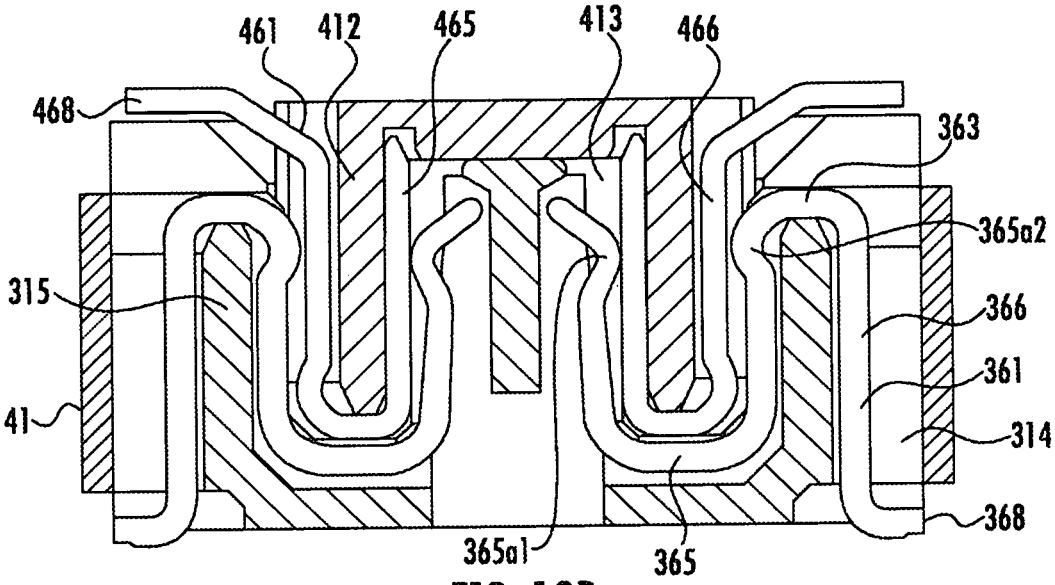
FIG. 13B is a cross-sectional view of the connector depicted in FIG. 13A, taken along line C-C.
Figure 14:
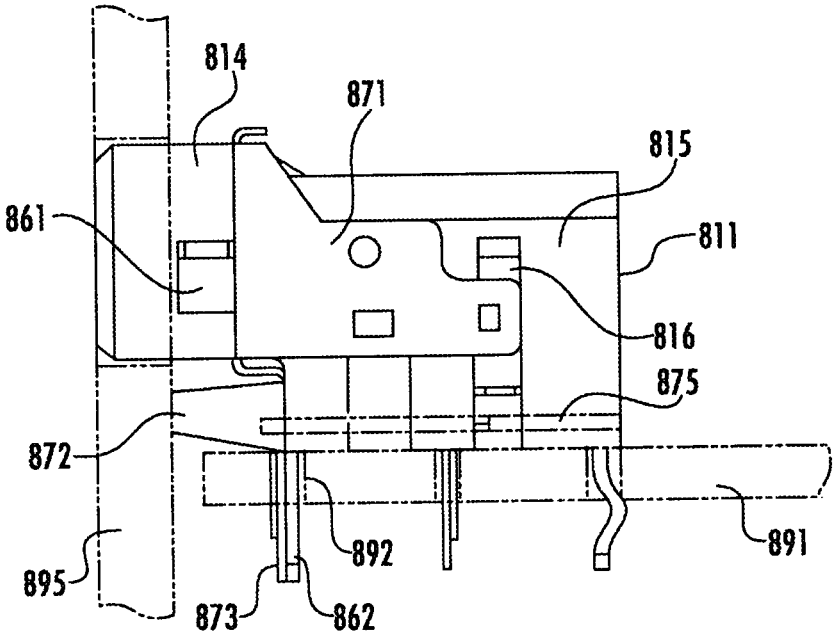
FIG. 14 (PRIOR ART)
FIG. 14 shows a side view of a prior art connector.

When the connector 301 is mated with the other connector 401, as shown in FIG. 12A and FIG. 12B, the mating face of the connector 301 is oriented so as to oppose the mating face of the other connector 401, the position of the left and right convex portions 412 of the other connector 401 are aligned with the left and right recessed groove portions 312*a* of the connector 301, and the position of the protruding end portions 422 of the other connector 401 are aligned with the positions of the protruding end recessed portions 322 of the connector 301. Here, the connector 301 and the other connector 401 have already been mounted on their respective substrates. However, for the sake of clarity, the substrates have been omitted from the drawing.

When the connector 401 is moved closer to the connector 301 in the mating direction, the convex portions 412 and protruding end portions 422 of the connector 401 are inserted into the recessed groove portions 312*a* and protruding end recessed portions 322 of the connector 301. A terminal 461 is inserted between the first contact portion 365*a*1 and the second contact portion 365*a*2 of each terminal 361, the first contact portion 365*a*1 of the terminal 361 comes into contact with the arm portion 465 of the other terminal 461, and the second contact portion 365*a*2 of the terminal 361 comes into contact with the main portion 466 of the other terminal 461.

In this way, an electrical connection is established between the terminals 361 and the other terminals 461. As a result, an electrical connection is established between the conductive traces of the connection pads on the substrate connected to the tail portions 368 of the terminals 361, and the conductive traces of the connection pads on the substrate connected to the tail portions 468 of the other terminals 461. Because the interval between the first contact portion 365*a*1 and the second contact portion 365*a*2 of each terminal 361 is elastically expanded when another terminal 461 is inserted, the first contact portion 365*a*1 applies pressure to the arm portion 465 and the second contact portion 365*a*2 applies pressure to the main portion 466 due to the spring action serving as the rebound force. Therefore, an electrical connection can be reliably maintained between the terminals 361 and the other terminals 461.

As mentioned above, the sheet 41 is affixed to cover the entire side face except for the mating face and the mounting face of the connector 301. Because the sheet 41 suppresses noise, it is preferably affixed where the most noise is generated, where the effect of noise is the greatest, and where the terminals 361 are connected to the other terminals 461. In order to make the affixing operation easier, the sheet 41 is preferably affixed to the outer face of the housing 311.

When the connector 301 is mated with the other connector 401, the housing 411 on the other connector 401 is inserted into and accommodated inside the recessed portion 312 of the housing 311. As a result, it is practically impossible to affix the sheet 41 to the mating faces of the housing 311 and the other housing 411, and to the side face of the other housing 411. Because the connector 301 and the other connector 401 are mounted on the surface of their respective substrates, it is also practically impossible to affix the sheet 41 to the mounting faces of the housing 311 and the other housing 411. Therefore, in the present embodiment, the sheet 41 is affixed to the outer side face of the side wall portion 315 of the housing 311.

In the example shown in the drawing, the sheet 41 is affixed so as to cover the entire outer side face of the side wall portion 315. However, it does not have to cover the outer side face of the side wall portion 315 in the entire thickness direction of the side wall portion 315. Instead, it can cover a portion corresponding to where the first contact portion 365*a*1 and the second contact portion 365*a*2 of each terminal 361 contacts another terminal 461. In other words, it may cover the portion directly above the point of contact between the terminals 361 and the other terminals 461 as viewed from the centerline of the connector 301 in the width direction. Also, in the example shown in the drawing, the sheet 41 is affixed to the outer side face of the protruding end portion 321 of the housing 311. However, it does not have to be affixed to the outer side face of the protruding end portion 321. In other words, the sheet 41 may be affixed to the outer face of the housing 311 so as to cover at least the portion directly above the point of contact between the terminals 361 and the other terminals 461.

As can be appreciated, therefore, connector 301 has a housing 311 mated with another connector 401, terminals 361 secured to the housing 311 and contacting the terminals 461 of the other connector 401, and a sheet 41 affixed to the housing 311. The sheet 41 has a laminate structure with a magnetic layer 42 and a dielectric layer 43. This configuration can help suppress noise and suppress adverse effects on signal integrity. The resulting connector 301 is less expensive and has improved durability and reliability.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing configured to be mated with another connector, a terminal secured to the housing, the terminal including a contact configured to mate with a terminal of the another connector, and a sheet affixed to the housing, wherein the sheet includes an electromagnetic interference suppressive sheet having a laminate structure of a soft magnetic layer and a conductive/dielectric layer, the soft magnetic layer including a soft magnetic powder and a resin being laminated on the conductive/dielectric layer, the conductive/dielectric layer including a conductive filler and a resin, the electrical resistance of the conductive/dielectric layer being from 0.5 to 20 Ω·cm, and the real parts of the complex relative permeability of the soft magnetic layer at 100 MHz being from 20 to 45.

2. A connector according to claim 1, wherein the sheet is affixed to an outer face of the housing so as to cover a portion directly above the contact.

3. A connector with a sheet according to claim 2, wherein the outer face is not a mating face or a mounting face.

4. A connector according claim 1, wherein the housing is made of a dielectric material, and a first dielectric constant of the conductive/dielectric layer is greater than an effective dielectric constant of the housing.

5. A connector according to claim 1, wherein the sheet is laminated so the conductive/dielectric layer is adjacent to the housing, and the soft magnetic layer is adjacent to the conductive/dielectric layer.

6. A connector according to claim 1, wherein the connector is a first connector, further comprising a second connector, the second connector being a cable connector.

7. A connector according to claim 1, wherein the soft magnetic powder used in the soft magnetic layer is a flaky soft magnetic metal powder, and the conductive filler used in the conductive/dielectric layer is conductive carbon fibers.

* * * * *